US010272687B2

(12) United States Patent
Sasaki et al.

(10) Patent No.: US 10,272,687 B2
(45) Date of Patent: Apr. 30, 2019

(54) RECORDING APPARATUS

(71) Applicant: SEIKO EPSON CORPORATION, Tokyo (JP)

(72) Inventors: Keisuke Sasaki, Matsumoto (JP); Kazuo Saito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/912,124

(22) Filed: Mar. 5, 2018

(65) Prior Publication Data

US 2018/0272719 A1 Sep. 27, 2018

(30) Foreign Application Priority Data

Mar. 21, 2017 (JP) ..... 2017-054069

(51) Int. Cl.

| | |
|---|---|
| ***B41J 2/17*** | (2006.01) |
| ***B41J 2/21*** | (2006.01) |
| ***B41J 2/14*** | (2006.01) |
| ***B41J 2/175*** | (2006.01) |
| ***B41J 2/165*** | (2006.01) |
| ***B41J 23/02*** | (2006.01) |
| ***B41J 29/02*** | (2006.01) |
| ***B41J 29/13*** | (2006.01) |
| ***B41J 29/38*** | (2006.01) |
| ***B41J 13/10*** | (2006.01) |

(52) U.S. Cl.

CPC ..... *B41J 2/1721* (2013.01); *B41J 2/14* (2013.01); *B41J 2/1652* (2013.01); *B41J 2/16523* (2013.01); *B41J 2/1752* (2013.01); *B41J 2/17513* (2013.01); *B41J 2/2114* (2013.01); *B41J 13/103* (2013.01); *B41J 23/025* (2013.01); *B41J 29/02* (2013.01); *B41J 29/13* (2013.01); *B41J 29/38* (2013.01)

(58) Field of Classification Search

CPC . B41J 2/1721; B41J 2/14; B41J 2/1652; B41J 2/16523; B41J 2/17513; B41J 2/1752; B41J 2/2114; B41J 12/103

See application file for complete search history.

(56) References Cited

U.S. PATENT DOCUMENTS

| | | | | |
|---|---|---|---|---|
| 2004/0091283 | A1 | 5/2004 | Nobe et al. | |
| 2014/0063092 | A1* | 3/2014 | Nakamura | B41J 25/308 347/8 |
| 2018/0253044 | A1* | 9/2018 | Horie | G03G 15/2064 |

FOREIGN PATENT DOCUMENTS

| | | |
|---|---|---|
| JP | 2004-154974 A | 6/2004 |

* cited by examiner

*Primary Examiner* — Lamson D Nguyen
(74) *Attorney, Agent, or Firm* — Workman Nydegger

(57) ABSTRACT

A recording apparatus includes: a center frame that supports a recorder which performs recording on a medium; and at least two side frames positioned with the center frame interposed therebetween. The two side frames include: a first sub-frame to which both of a first feeder and a second feeder that feed a medium are mountable, the second feeder differing from the first feeder in the position from which to feed a medium; and a second sub-frame to which one of the first feeder and the second feeder is mountable. The second sub-frame includes a support portion that supports a power transmission unit which transmits drive power from a motor to the first feeder or the second feeder, the motor being a drive source necessary to feed a medium.

10 Claims, 35 Drawing Sheets

RECORDING APPARATUS

BACKGROUND

1. Technical Field

The present invention relates to a recording apparatus for performing recording on a medium.

2. Related Art

Heretofore, recording apparatuses such as laser printers and ink jet printers employ, for example, a rear feed method in which a medium is fed from the rear side of the apparatus or a front feed method in which a medium is fed from a medium housing cassette that can be inserted into and pulled out from the front side of the apparatus, in order to feed a medium to a record unit that performs recording on the medium.

Different medium feed methods, such as the rear feed method and the front feed method, require different configurations of the frame constituting the apparatus body. Further, an ink jet printer performs recording by ejecting ink toward a medium from nozzles on a record head. Thus, an ink feeder that feeds liquid (hereinafter, referred to as ink) to the nozzles of the record head needs to be provided. As for the method of feeding the ink, there are an on-carriage method in which an ink cartridge is mounted on a carriage and an off-carriage method in which the ink is fed through a tube from an ink tank provided inside the apparatus. The configuration of the frame constituting the apparatus body is different depending on whether the on-carriage method is employed or the off-carriage method is employed.

Further, in ink jet printers, a waste-liquid storage that sucks and stores waste liquid (waste ink) ejected from the record head includes a waste-liquid containing portion for containing the waste liquid, and the configuration of the frame constituting the apparatus body is also different depending on a configuration difference, for example, whether the waste-liquid containing portion is fixed to the apparatus body or detachably mounted to the apparatus body.

As mentioned above, the specifications of a frame assembly constituting the apparatus body of a recording apparatus differ by the medium feed method, the ink feed method, and the like, and the frame assembly is therefore a dedicated member designed according to the specifications. The frame assembly, which is a dedicated member, includes a plurality of frames formed from, for example, sheet metal or resin. In the case of frames made of, for example, resin, they are manufactured with dedicated molds. Then, molds for manufacturing dedicated frames are needed for each type of recording apparatus. This not only raises the cost of the molds, but also lengthens the time of development of the recording apparatus since time is also needed to design the molds.

Meanwhile, JP-A-2004-154974 describes a laser printer to which one of two types of mechanisms differing from each other by the model to be provided can be selectively mounted.

More specifically, a multipurpose unit and a manual feed unit, which are two units differing in function, share a structure for them to be mounted to left and right frames. This eliminates the need for manufacturing different frames for different models of the laser printer, and can reduce the manufacturing cost.

However, the configuration of the laser printer described in JP-A-2004-154974 is such that the two units differing in function are provided on the front side of the apparatus. Thus, it is difficult to selectively mount one of units each positioned over a wide area in the apparatus, such as a rear feeder that implements a rear feed method and a front feeder that implements a front feed method as mentioned above. Therefore, in order to mount one of the rear feeder and the front feeder in accordance with the model of the printer, it is still necessary to employ a dedicated frame configuration for each of them.

Here, different types of feeders in particular require different configurations of a power transmission unit that transmits power from a motor to the feeder in most cases. Such a situation leads to a further need to employ dedicated frame configurations.

SUMMARY

An advantage of some aspects of the invention is reduction of the cost of frames in particular required in a case where at least one of two or more feeders differing in specification is mounted according to the model of the apparatus.

Also, another advantage of some aspects of the invention is reduction of the cost required in a case where at least one of two or more apparatus elements differing in specification is mounted according to the model of the apparatus, the apparatus elements including but not limited to the above feeders.

An aspect of the invention to solve the above problems provides a recording apparatus characterized in that the recording apparatus includes a center frame that supports a recorder which performs recording on a medium, and at least two side frames positioned with the center frame interposed therebetween, in which the two side frames include a first sub-frame to which both of a first feeder and a second feeder that feed a medium are mountable, the second feeder differing from the first feeder in a position from which to feed a medium, and a second sub-frame to which one of the first feeder and the second feeder is mountable, and the second sub-frame includes a support portion that supports a power transmission unit which transmits drive power from a motor to the first feeder or the second feeder, the motor being a drive source necessary to feed a medium.

According to this aspect of the invention, the frames of the recording apparatus include the center frame and the at least two side frames, which are positioned with the center frame interposed therebetween, and both of the first feeder and the second feeder are mountable to one of the two side frames, namely the first sub-frame. In this way, a recording apparatus model including the first feeder (hereinafter, referred to as "first model") and a recording apparatus model including the second feeder (hereinafter, referred to as "second model") can share at least the center frame and the first frame. This can suppress increase in apparatus cost.

Further, one of the first feeder and the second feeder is mountable to the other of the two side frames. In other words, the second sub-frame is a dedicated frame for the first model or the second model. The second sub-frame includes the support portion, which supports the power transmission unit, which transmits drive power to the first feeder or the second feeder. In other words, the second sub-frame includes the support portion as a portion that is likely to be most greatly differ in configuration between the case where the first feeder is employed and the case where the second feeder is employed. This can eliminate the need for a design taking into account the difference between the first model and the second model in the frames other than the second sub-frame, or minimize a design taking into account the difference between the first model and the second model in the frames other than the second sub-frame. Hence, it is possible to more effectively suppress increase in apparatus cost.

It is preferable that the recording apparatus further includes a first switcher that switches a state of power transmission from the motor to the first feeder in a case where the first feeder is mounted to the first sub-frame and the second sub-frame or a second switcher that switches a state of power transmission from the motor to the second feeder in a case where the second feeder is mounted to the first sub-frame and the second sub-frame, in which the first switcher includes a first engagement portion that switches a state of power transmission of the first switcher by being engaged with and moved by a carriage which constitutes the recorder and moves back and forth in a predetermined direction, the second switcher includes a second engagement portion that switches a state of power transmission of the second switcher by being engaged with and moved by the carriage, and the center frame includes a first portion that permits the movement of the first engagement portion and a second portion that permits the movement of the second engagement portion.

In this case, the center frame includes the first portion, which permits the movement of the first engagement portion, and the second portion, which permits the movement of the second engagement portion. Both of the recording apparatus configured as the first model and the recording apparatus configured as the second model can therefore share the center frame. This can suppress increase in apparatus cost.

It is preferable that the first portion and the second portion are openings provided in the center frame.

In this case, the first portion and the second portion are openings provided in the center frame and can therefore simplify the configuration of the center frame.

It is preferable that a waste-liquid container that contains waste liquid ejected from a record head constituting the recorder is provided on the second sub-frame.

In this case, the waste-liquid container, which contains waste liquid ejected from the record head, constituting the recorder, is provided on the second sub-frame. Thus, the layout for sucking and containing the waste liquid ejected from the record head can be integrated on the second sub-frame. In this way, changes in the layout for sucking and containing the waste liquid can be limited to the second sub-frame. It is therefore possible to implement two or more types of specifications with the recording apparatus by only changing the second sub-frame.

It is preferable that the waste-liquid container is detachably mounted to the second sub-frame.

It is preferable that the waste-liquid container is fixed to the second sub-frame.

It is preferable that a liquid container capable of containing liquid to be ejected from a record head constituting the recorder is provided on the second sub-frame.

In these cases, the liquid container, capable of containing the liquid to be ejected from the record head, constituting the recorder, is provided on the second sub-frame. Thus, elements associated with the liquid can be gathered on the second sub-frame. Accordingly, influences of changes in these elements and their layout can be limited to the second sub-frame. It is therefore possible to implement two or more types of specifications by only changing the second sub-frame on the recording apparatus.

It is preferable that the first sub-frame includes a positioning portion that positions the first feeder relative to the first sub-frame in a case where the first feeder is mounted to the first sub-frame and the second sub-frame, and positions the second feeder relative to the first sub-frame in a case where the second feeder is mounted to the first sub-frame and the second sub-frame.

In this case, the positioning portion serves a function to position the first feeder and a function to position the second feeder. Therefore, the first feeder and the second feeder can share the positioning portion and do not need to be provided with their respective positioning portions. This can suppress increase in cost.

It is preferable that the first sub-frame includes a plurality of mount portions at which to mount the first feeder to the first sub-frame, and among the plurality of mount portions, a mount portion to be used only to fix the first feeder is provided at such a position as not to interfere with the second feeder when the second feeder is mounted to the first sub-frame.

In this case, the first sub-frame includes the plurality of mount portions, at which to mount the first feeder to the first sub-frame, and among the plurality of mount portions, the mount portion to be used only to fix the first feeder is provided at such a position as not to interfere with the second feeder when the second feeder is mounted to the first sub-frame. In this way, the first feeder and the second feeder can share the first sub-frame in an appropriate manner.

It is preferable that the recording apparatus further includes a medium transporter that transports a medium toward the recorder, in which a drive source that applies power to the medium transporter is provided on the second sub-frame, and the drive source applies power to the first feeder or the second feeder.

In this case, the drive source which applies power to the medium transporter is provided on the second sub-frame, and the drive source applies power to the first feeder or the second feeder. In this way, the power transmission system is integrated on the second sub-frame side. This reduces the power transmission loss and enables more appropriate power transmission.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the drawings. Note that identical elements in the embodiments will be denoted by identical numbers and described only in the first embodiment, and description thereof will be omitted in the subsequent embodiments.

Figure 1:
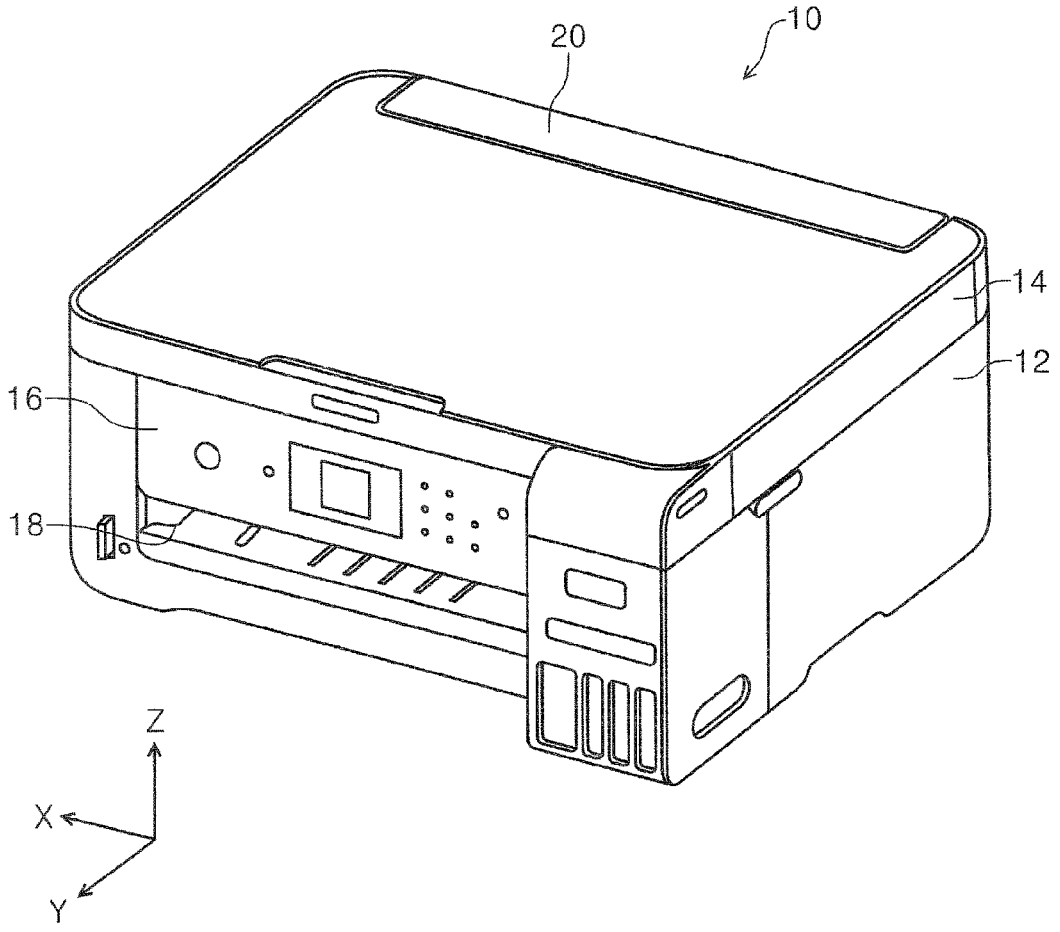
FIG. 1 is a perspective view of the exterior of a rear feed-type printer in an embodiment.
Figure 2:
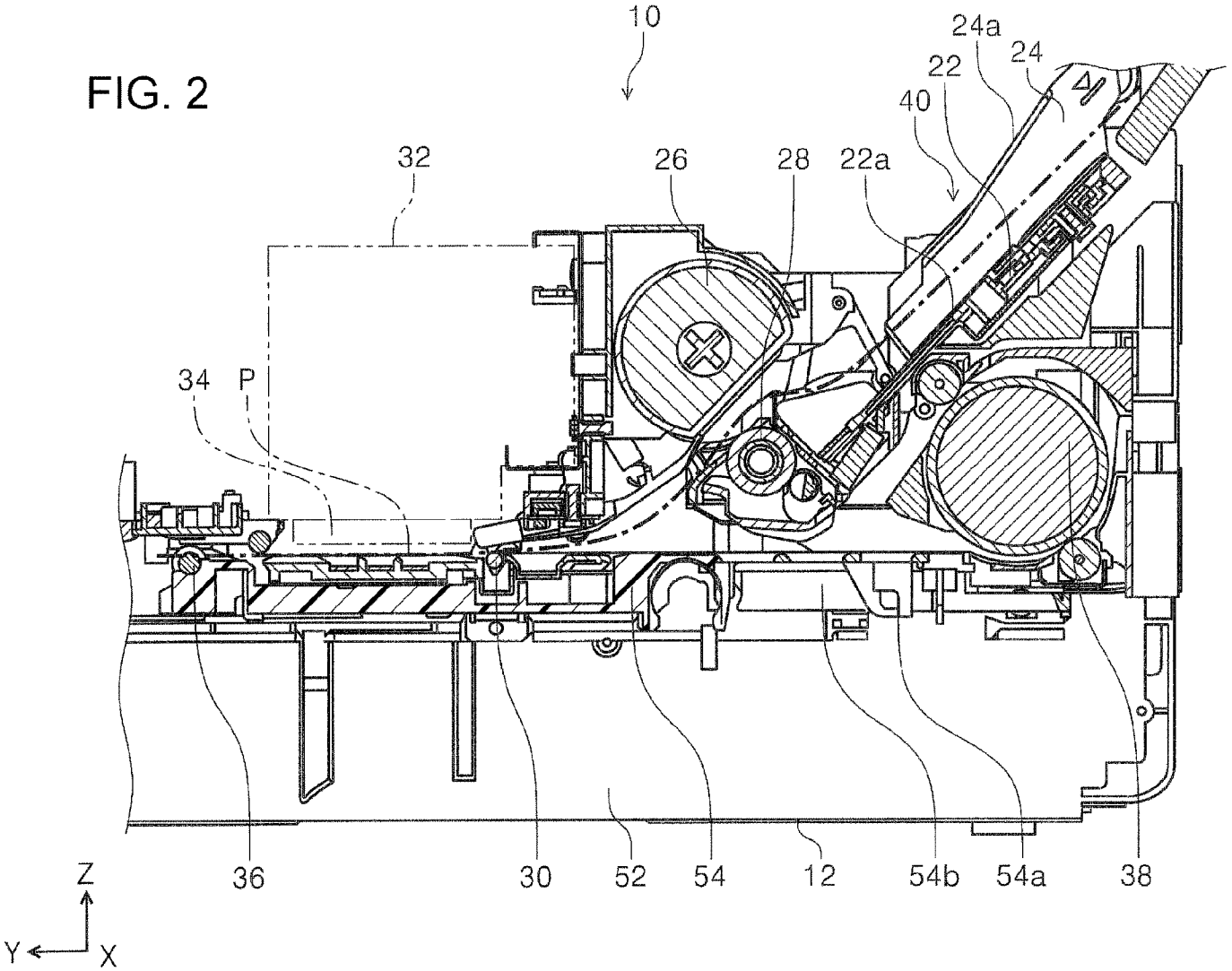
FIG. 2 is a side cross-sectional view illustrating a medium feed path in the rear feed-type printer.
Figure 3:
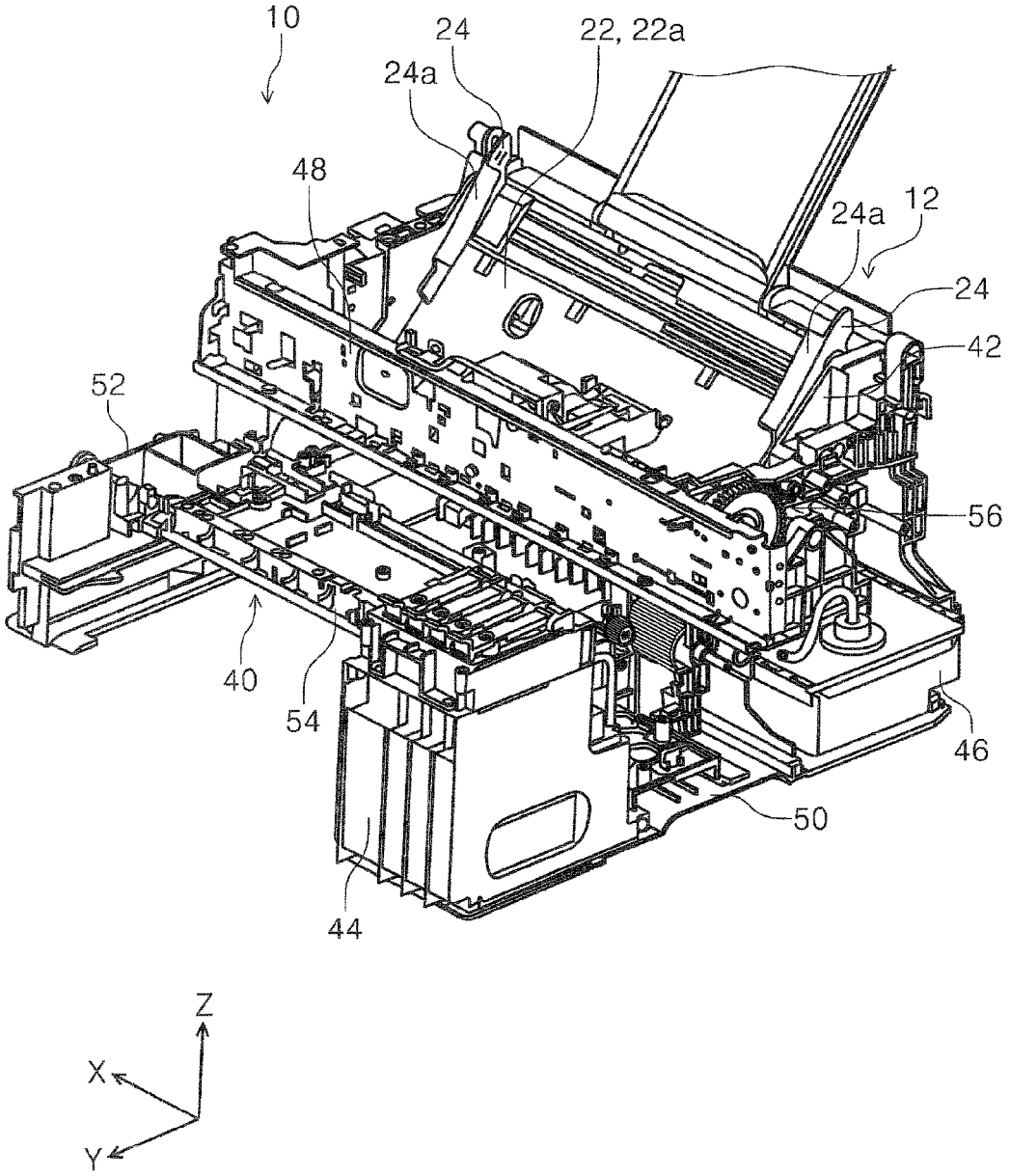
FIG. 3 is a perspective view of the apparatus body of the rear feed-type printer.
Figure 4:
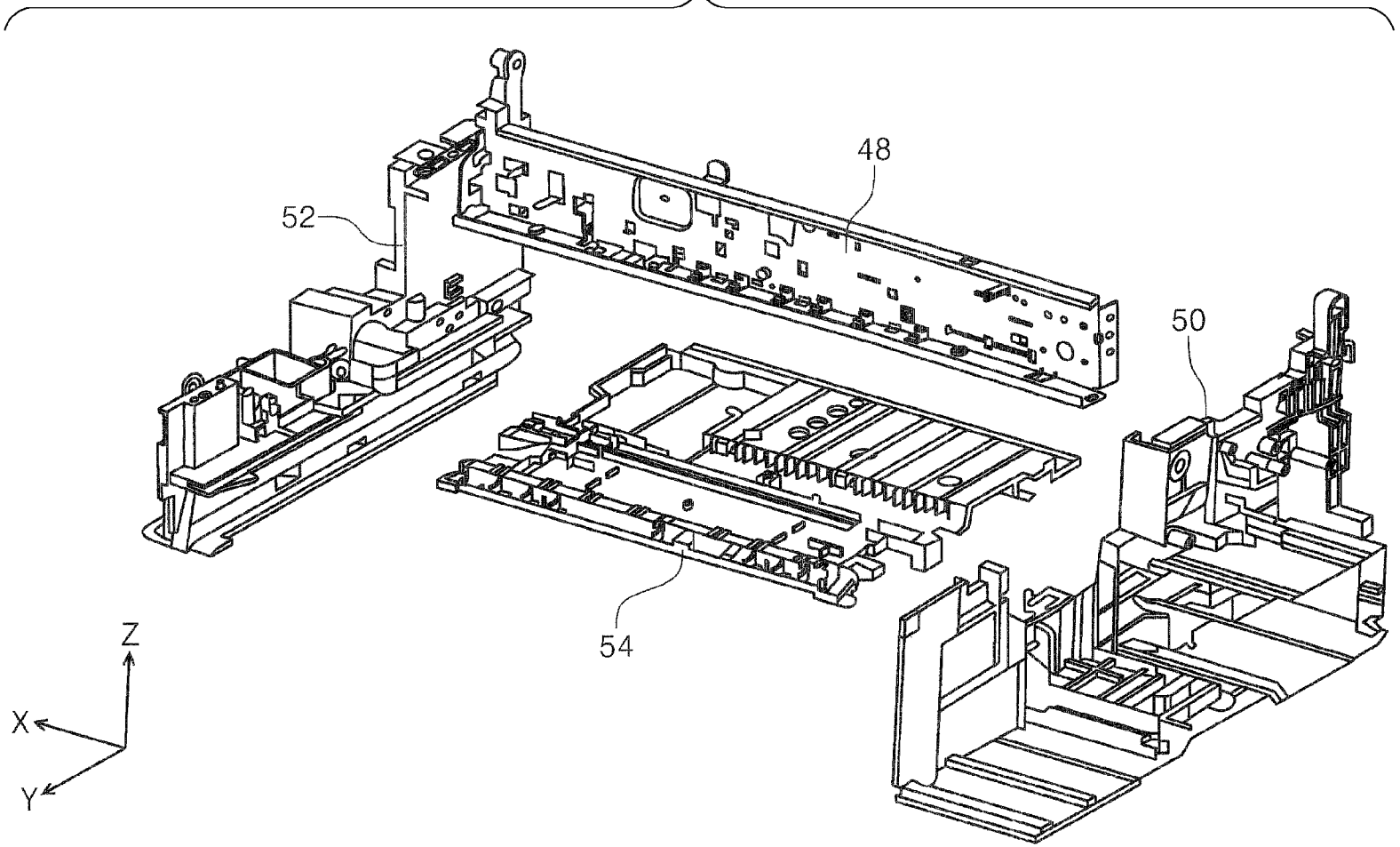
FIG. 4 is an exploded perspective view of a frame assembly of the rear feed-type printer.
Figure 5:
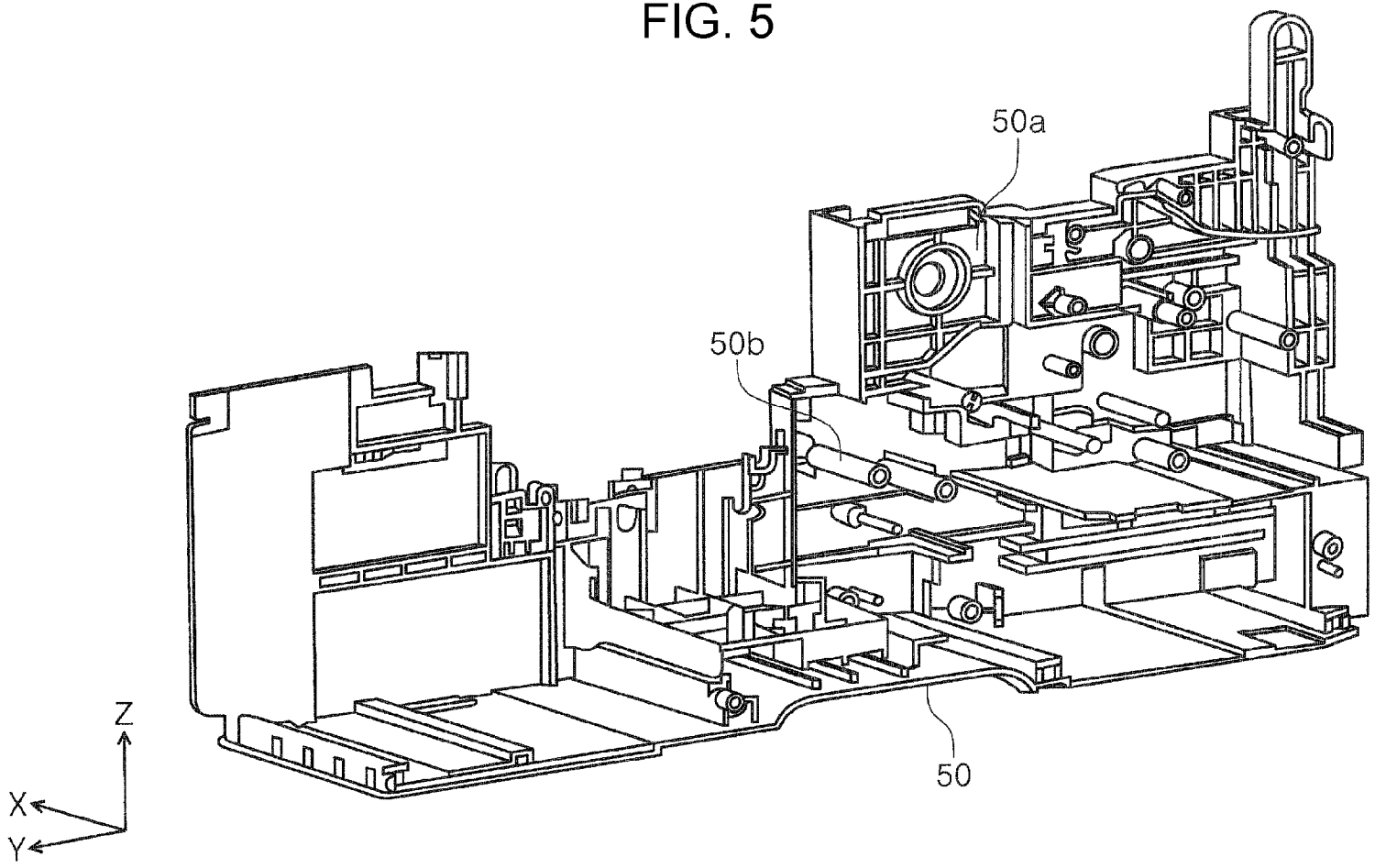
FIG. 5 is a perspective view of a second sub-frame of the rear feed-type printer.
Figure 6:
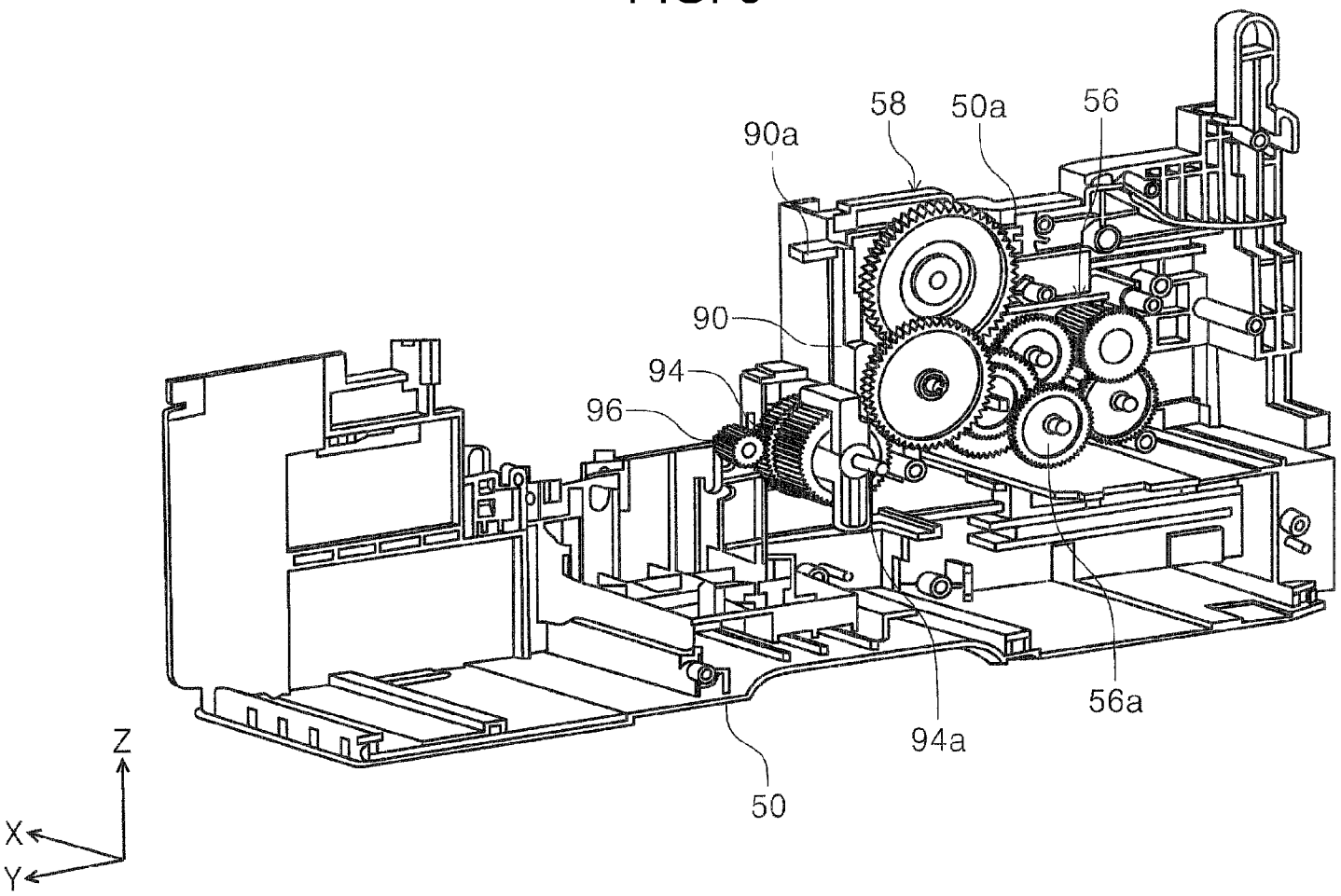
FIG. 6 is a perspective view illustrating a state where the second sub-frame is equipped with a first power transmission unit.
Figure 7:
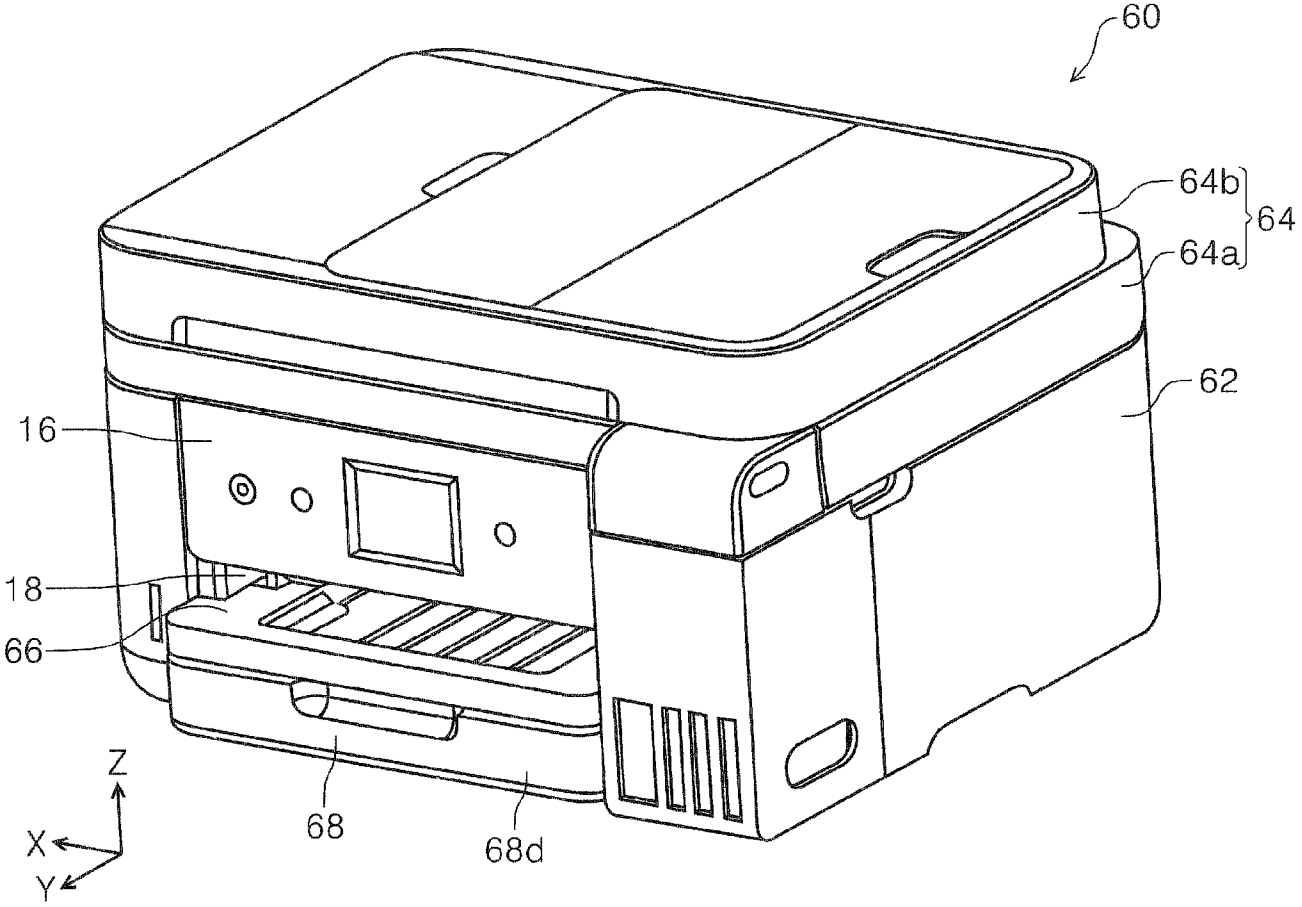
FIG. 7 is a perspective view of the exterior of a front feed-type printer in this embodiment.

FIG. 1 is a perspective view of the exterior of a rear feed-type printer in an embodiment. FIG. 2 is a side cross-sectional view illustrating a medium feed path in the rear feed-type printer. FIG. 3 is a perspective view of the apparatus body of the rear feed-type printer. FIG. 4 is an exploded perspective view of a frame assembly of the rear feed-type printer. FIG. 5 is a perspective view of a second sub-frame of the rear feed-type printer. FIG. 6 is a perspective view illustrating a state where the second sub-frame is equipped with a first power transmission unit. FIG. 7 is a perspective view of the exterior of a front feed-type printer in this embodiment.

Figure 8:
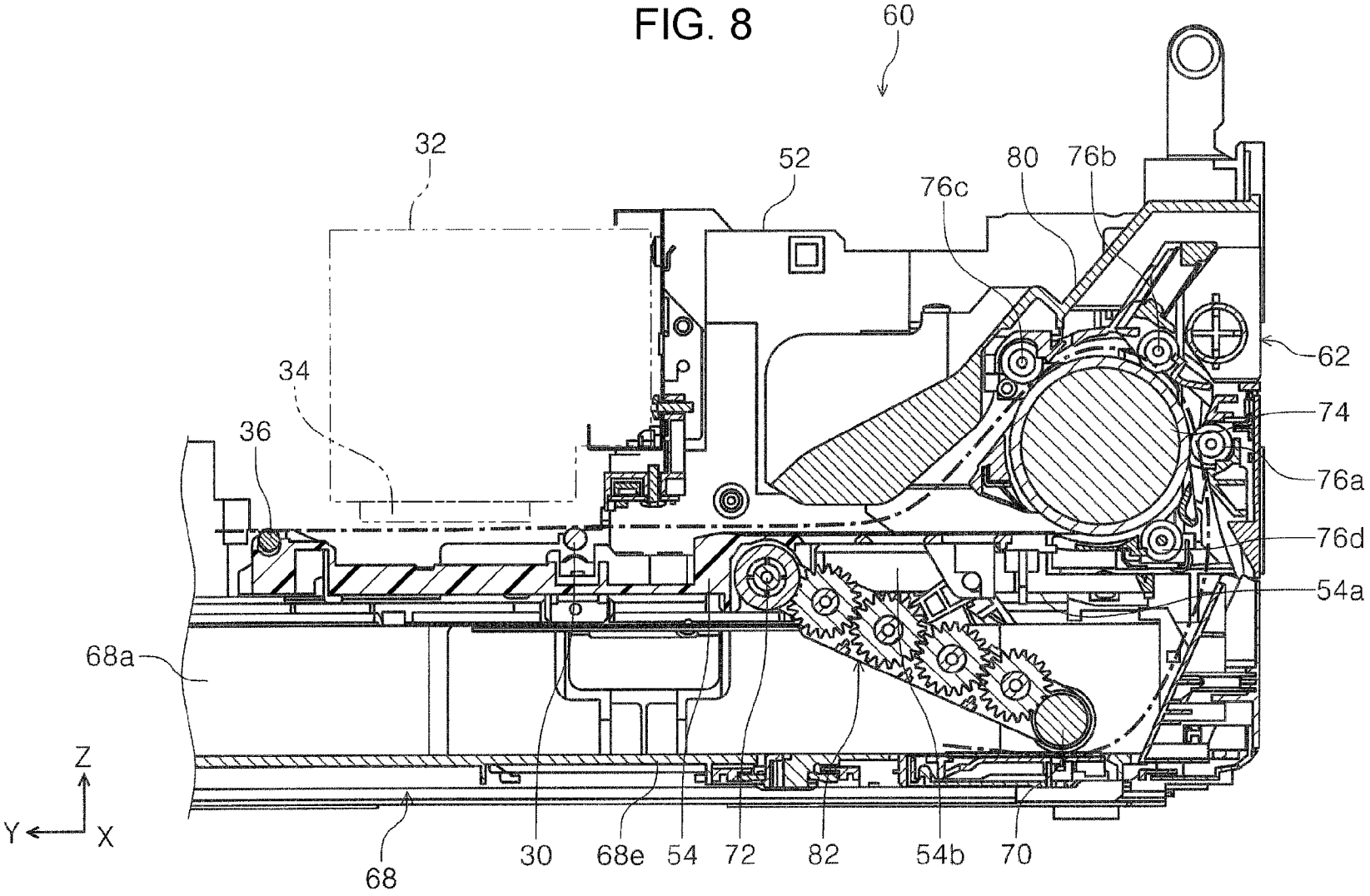
FIG. 8 is a side cross-sectional view illustrating a medium feed path in the front feed-type printer.
Figure 9:
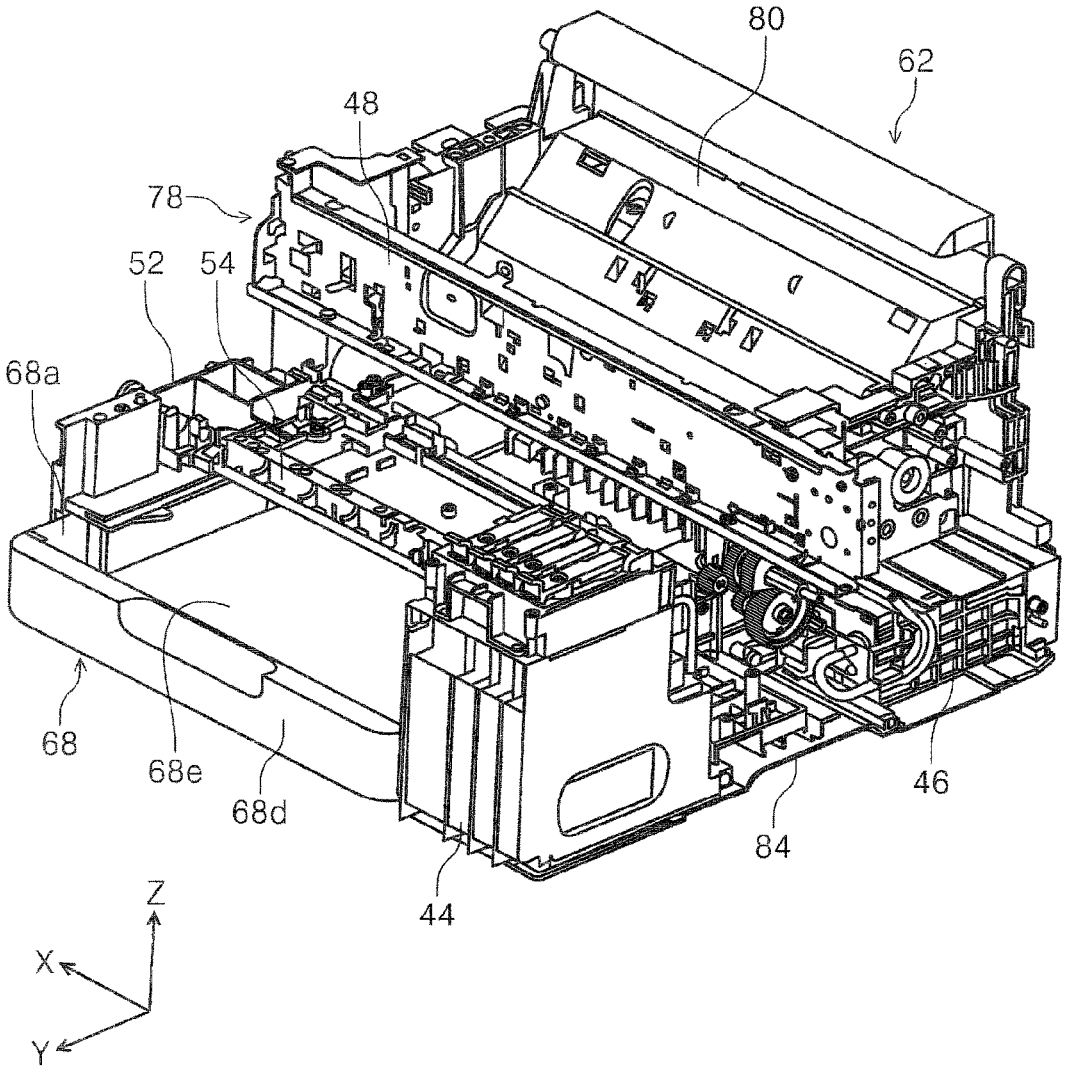
FIG. 9 is a perspective view of the apparatus body of the front feed-type printer.
Figure 10:
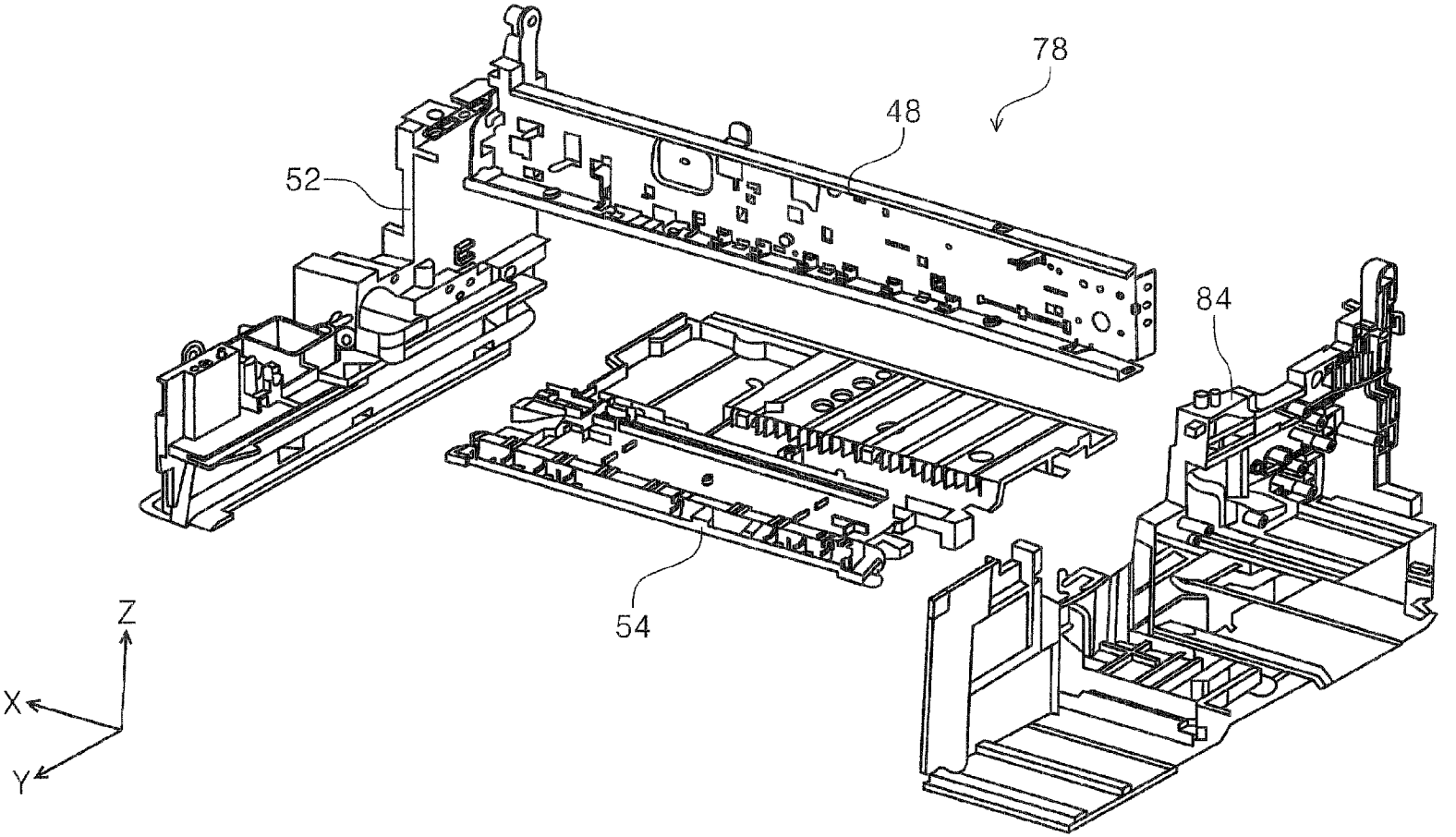
FIG. 10 is an exploded perspective view of a frame assembly of the front feed-type printer.
Figure 11:
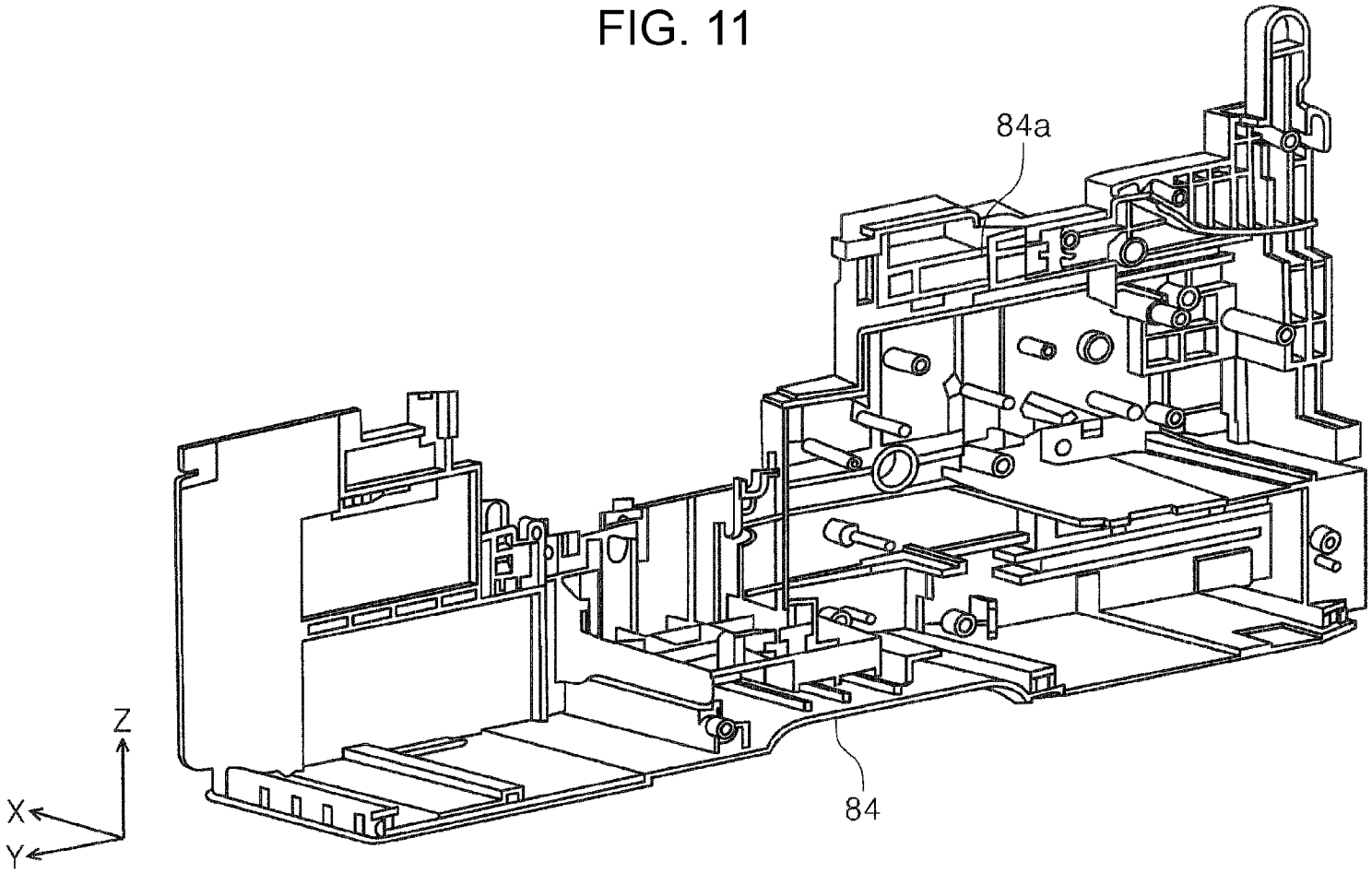
FIG. 11 is a perspective view of a second sub-frame of the front feed-type printer.
Figure 12:
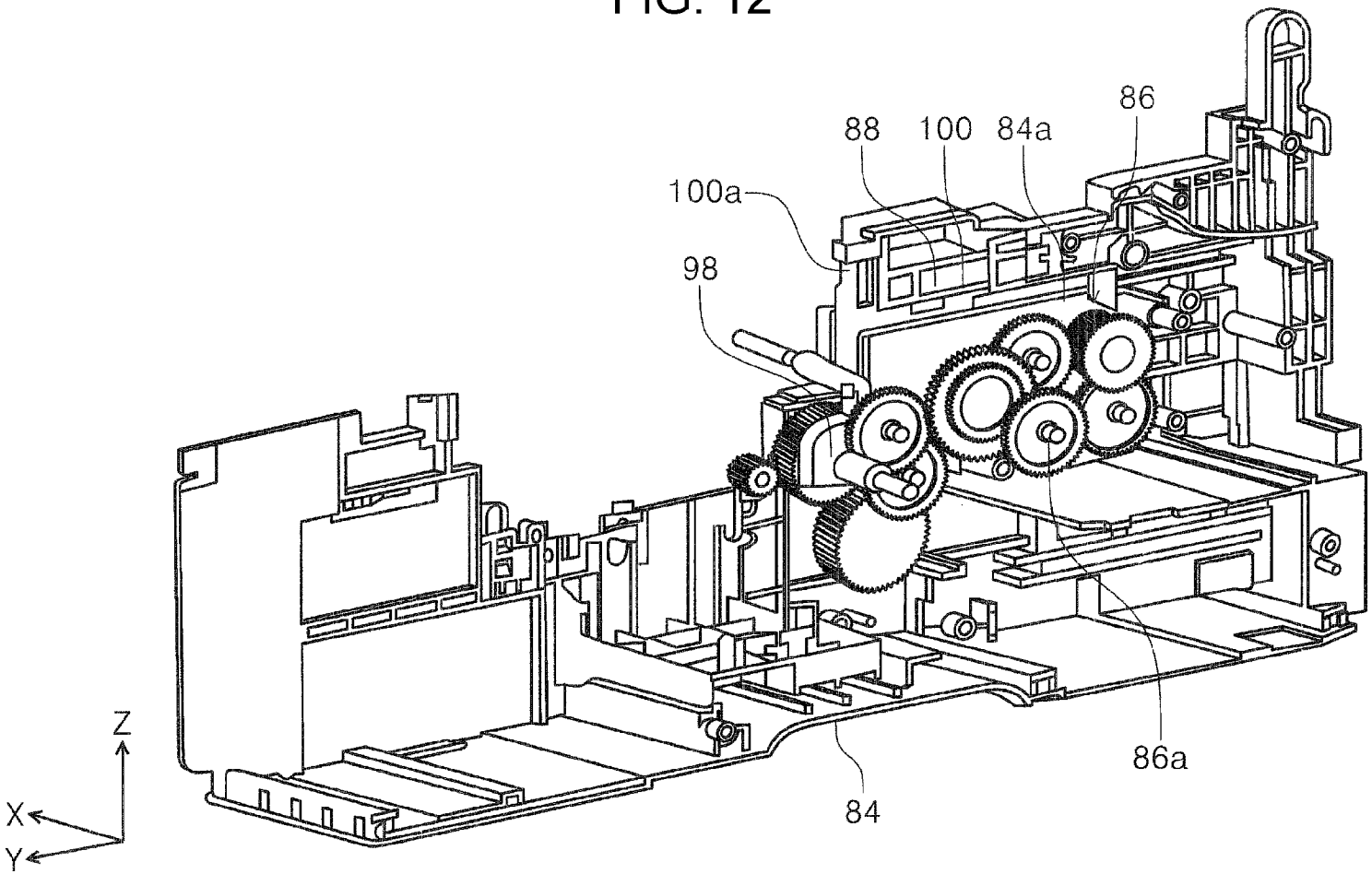
FIG. 12 is a perspective view illustrating a state where the second sub-frame is equipped with a second power transmission unit.
Figure 13:
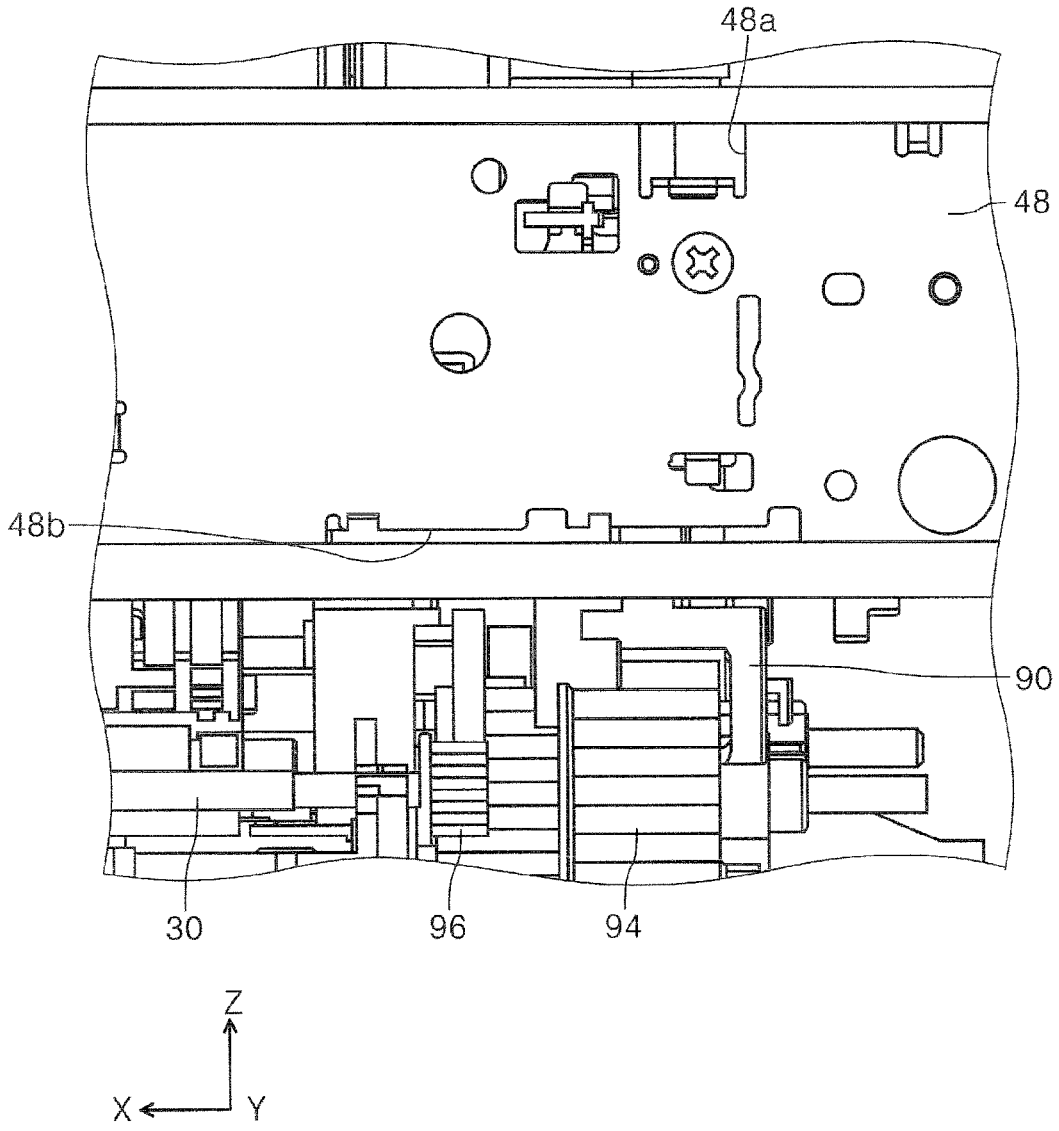
FIG. 13 is a front view illustrating a shared portion of a main frame and its surrounding area.
Figure 14:
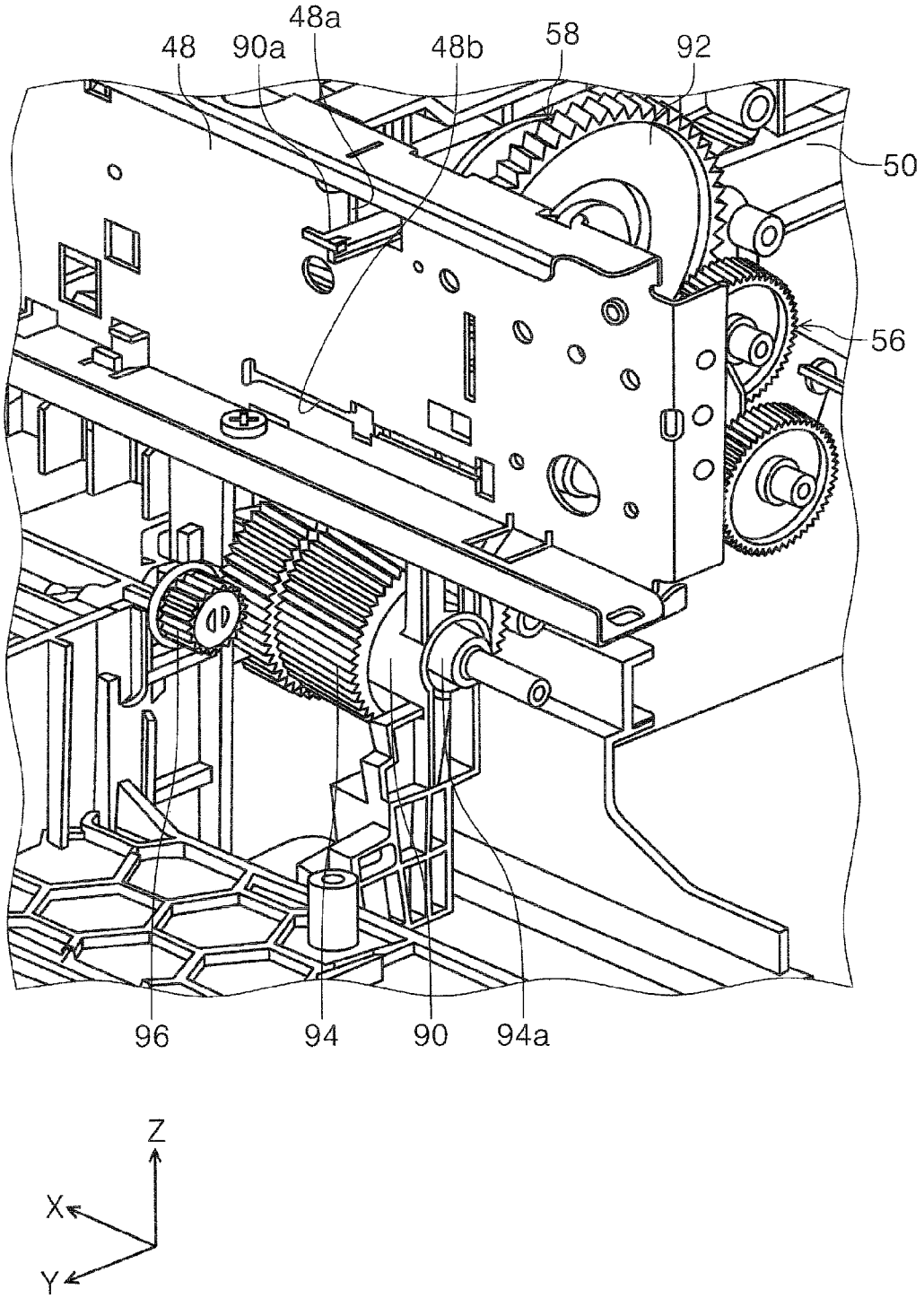
FIG. 14 is a perspective view illustrating the relation between a first switcher for the first power transmission unit and a permitting portion (shared portion) of the main frame.

FIG. 8 is a side cross-sectional view illustrating a medium feed path in the front feed-type printer. FIG. 9 is a perspective view of the apparatus body of the front feed-type printer. FIG. 10 is an exploded perspective view of a frame assembly of the front feed-type printer. FIG. 11 is a perspective view of a second sub-frame of the front feed-type printer. FIG. 12 is a perspective view illustrating a state where the second sub-frame is equipped with a second power transmission unit. FIG. 13 is a front view illustrating a shared portion of a main frame and its surrounding area. FIG. 14 is a perspective view illustrating the relation between a first switcher for the first power transmission unit and a permitting portion (shared portion) of the main frame.

Figure 15:
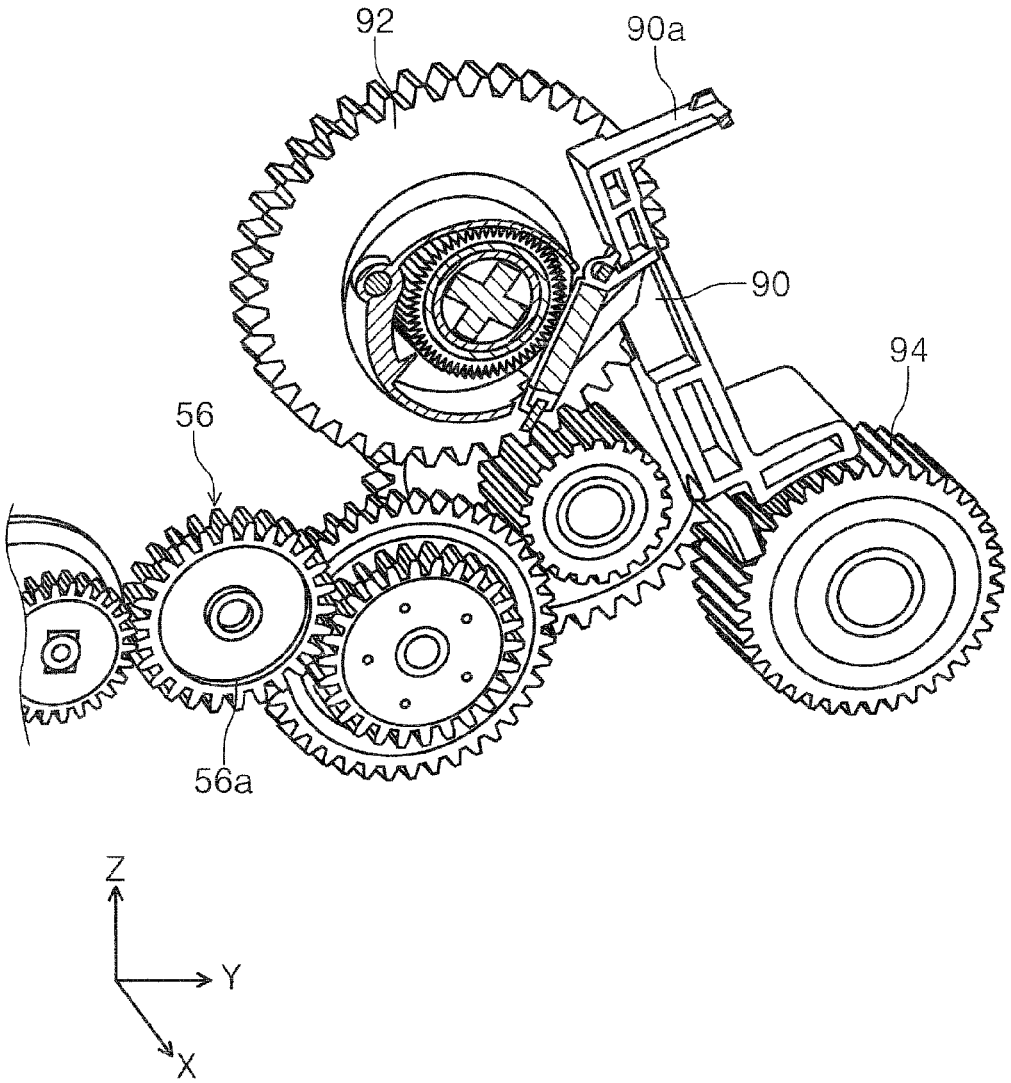
FIG. 15 is a view illustrating an overview of the first switcher.
Figure 16:
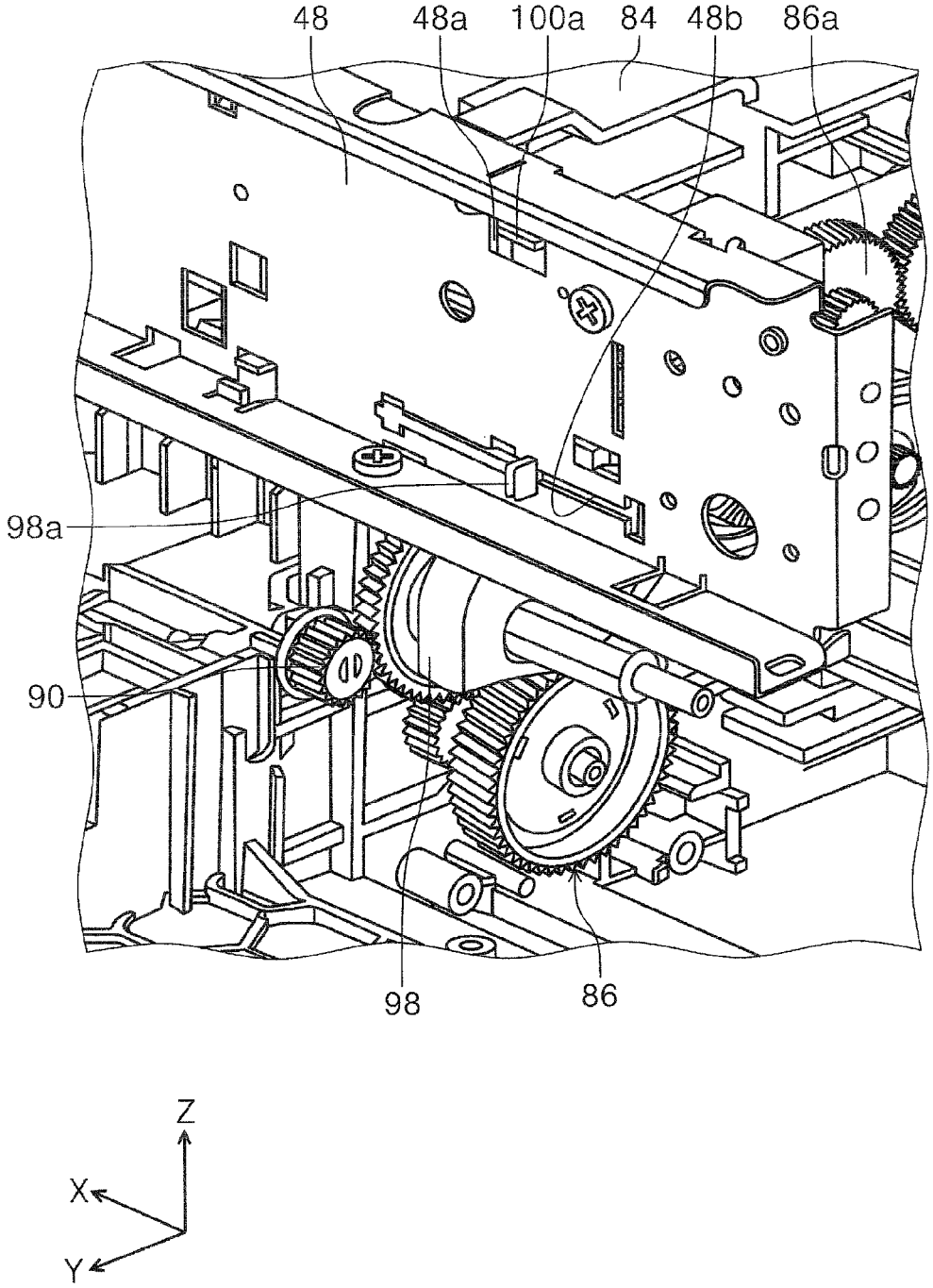
FIG. 16 is a perspective view illustrating the relation between a second switcher for the second power transmission unit and a fixing portion (shared portion) of the main frame.
Figure 17:
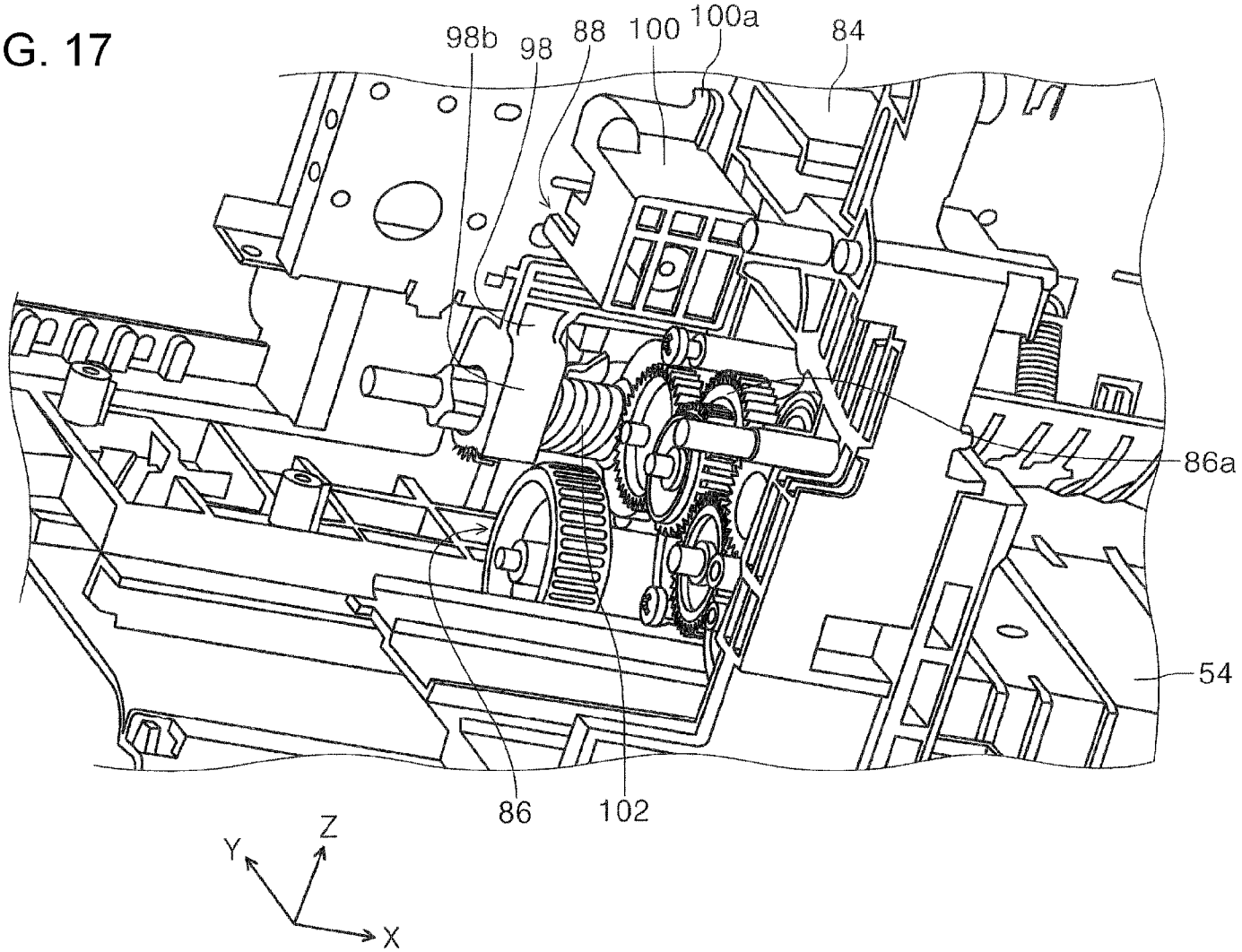
FIG. 17 is a perspective view illustrating the second power transmission unit in a non-power transmitting state.
Figure 18:
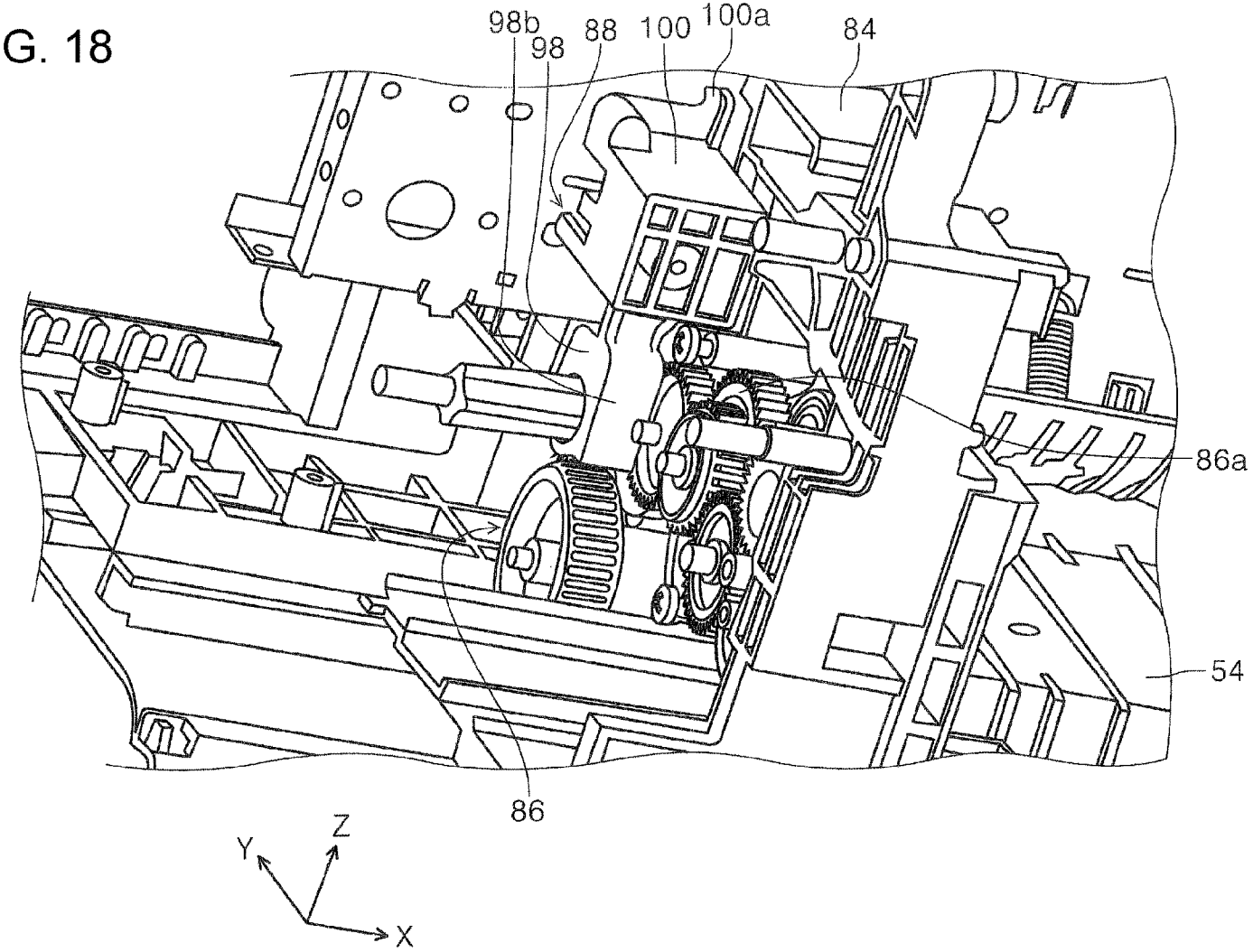
FIG. 18 is a perspective view illustrating the second power transmission unit in a power transmitting state.
Figure 19:
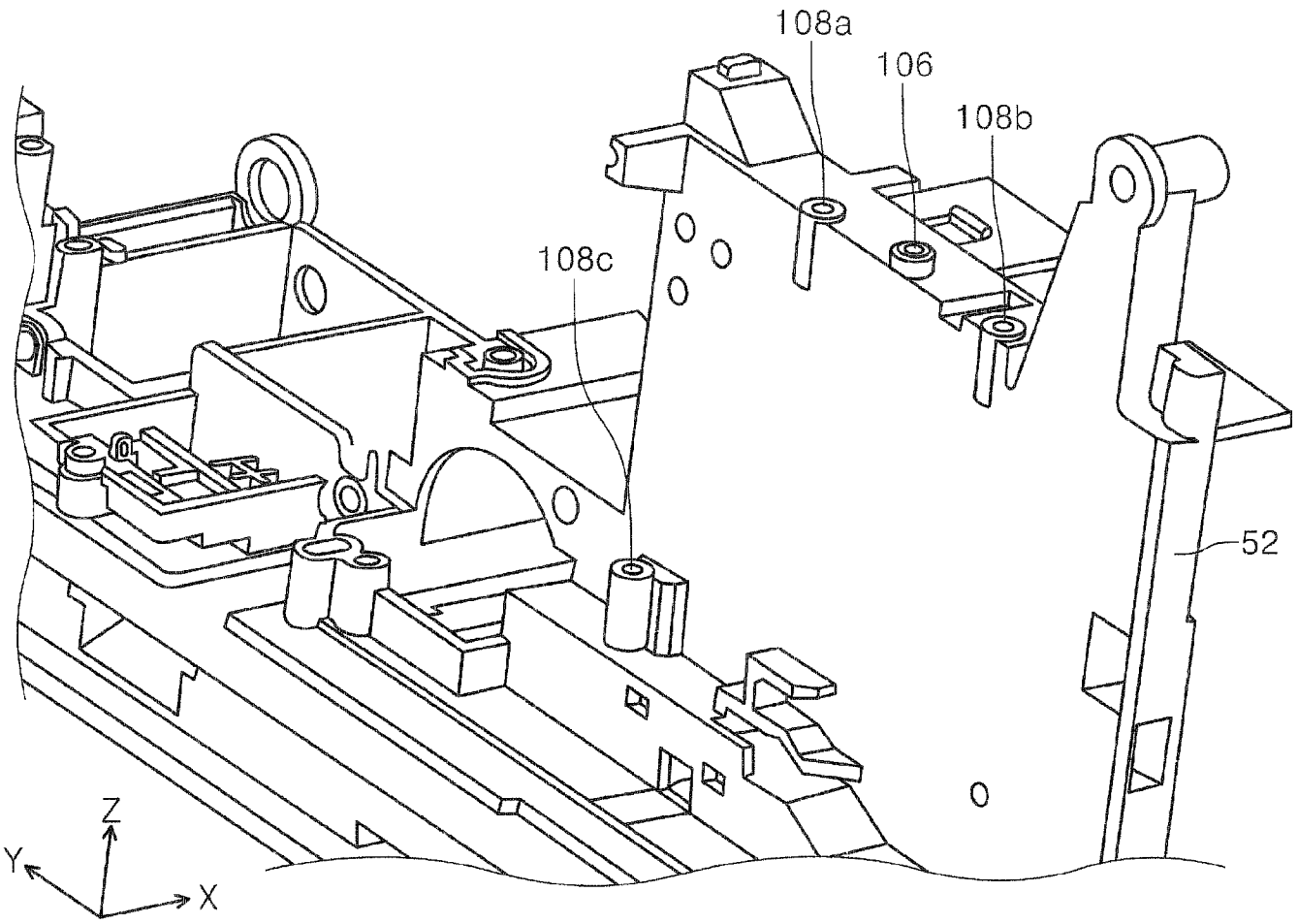
FIG. 19 is a perspective view illustrating a positioning portion and mount portions of a first sub-frame.
Figure 20:
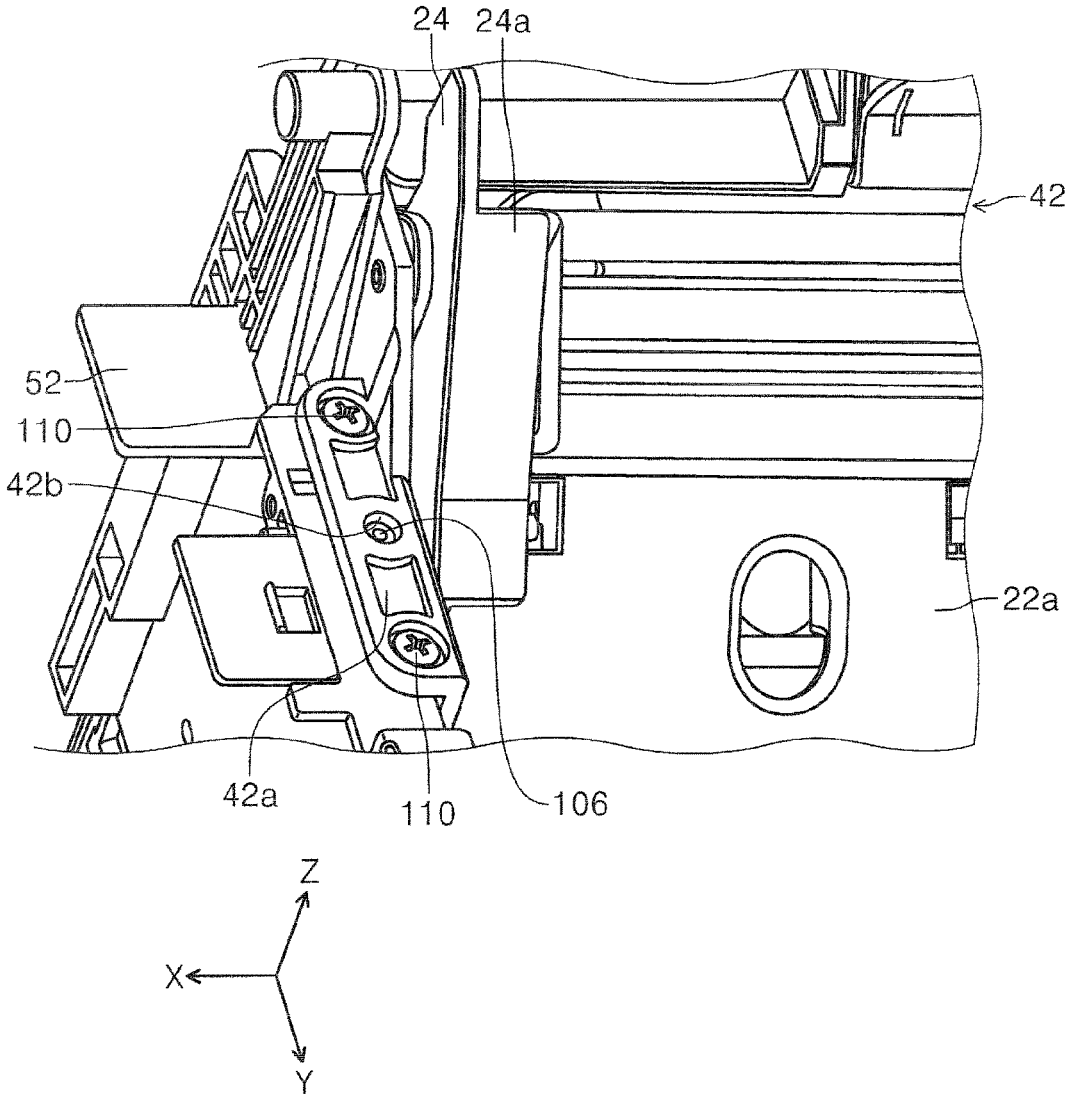
FIG. 20 is a perspective view illustrating the state of the positioning portion and the mount portions of the first sub-frame with a rear feed unit mounted thereto.
Figure 21:
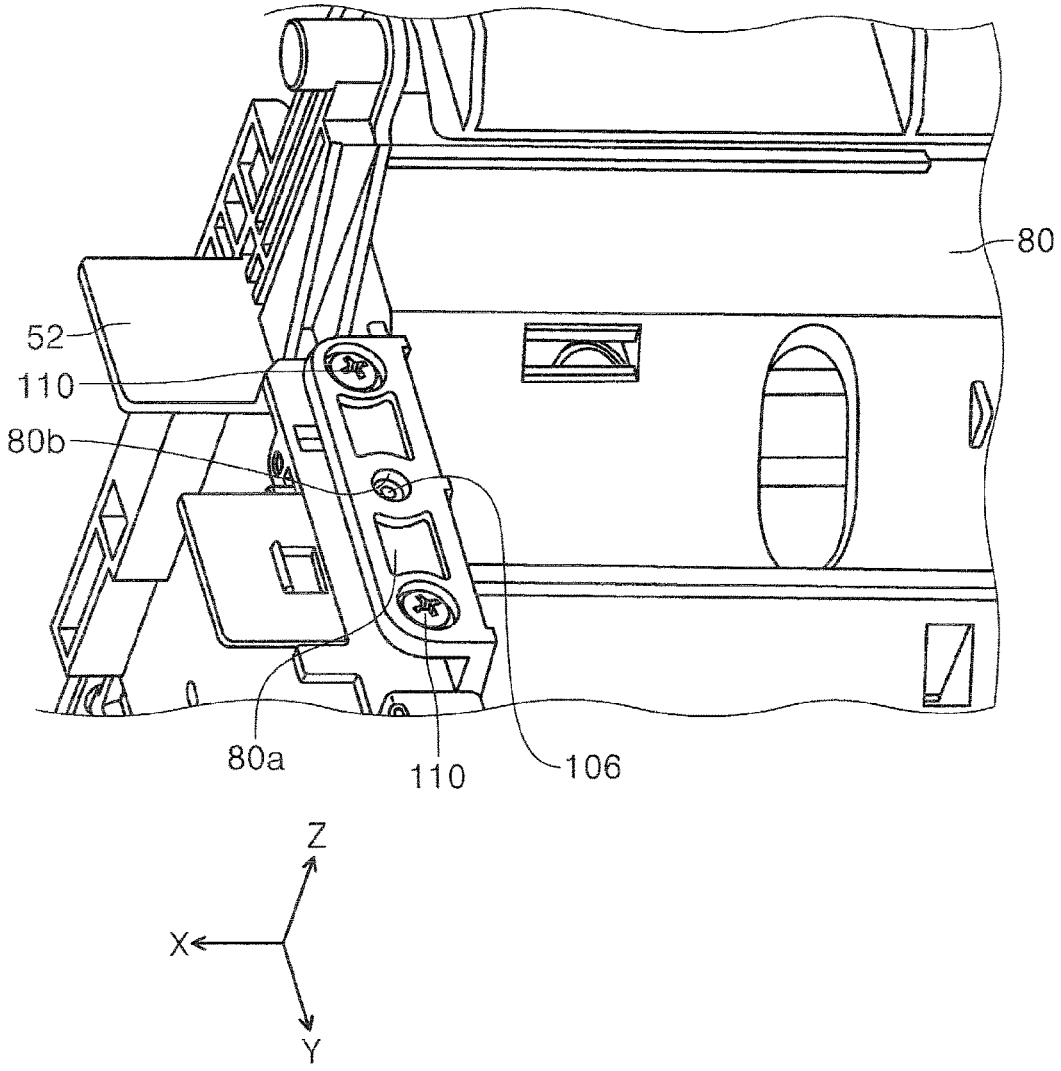
FIG. 21 is a perspective view illustrating the state of the positioning portion and the mount portions of the first sub-frame with a front feed unit mounted thereto.

FIG. 15 is a view illustrating an overview of the first switcher. FIG. 16 is a perspective view illustrating the relation between a second switcher for the second power transmission unit and a fixing portion (shared portion) of the main frame. FIG. 17 is a perspective view illustrating the second power transmission unit in a non-power transmitting state. FIG. 18 is a perspective view illustrating the second power transmission unit in a power transmitting state. FIG. 19 is a perspective view illustrating a positioning portion and mount portions of a first sub-frame. FIG. 20 is a perspective view illustrating the state of the positioning portion and the mount portions of the first sub-frame with a rear feed unit mounted thereto. FIG. 21 is a perspective view illustrating the state of the positioning portion and the mount portions of the first sub-frame with a front feed unit mounted thereto.

Figure 22:
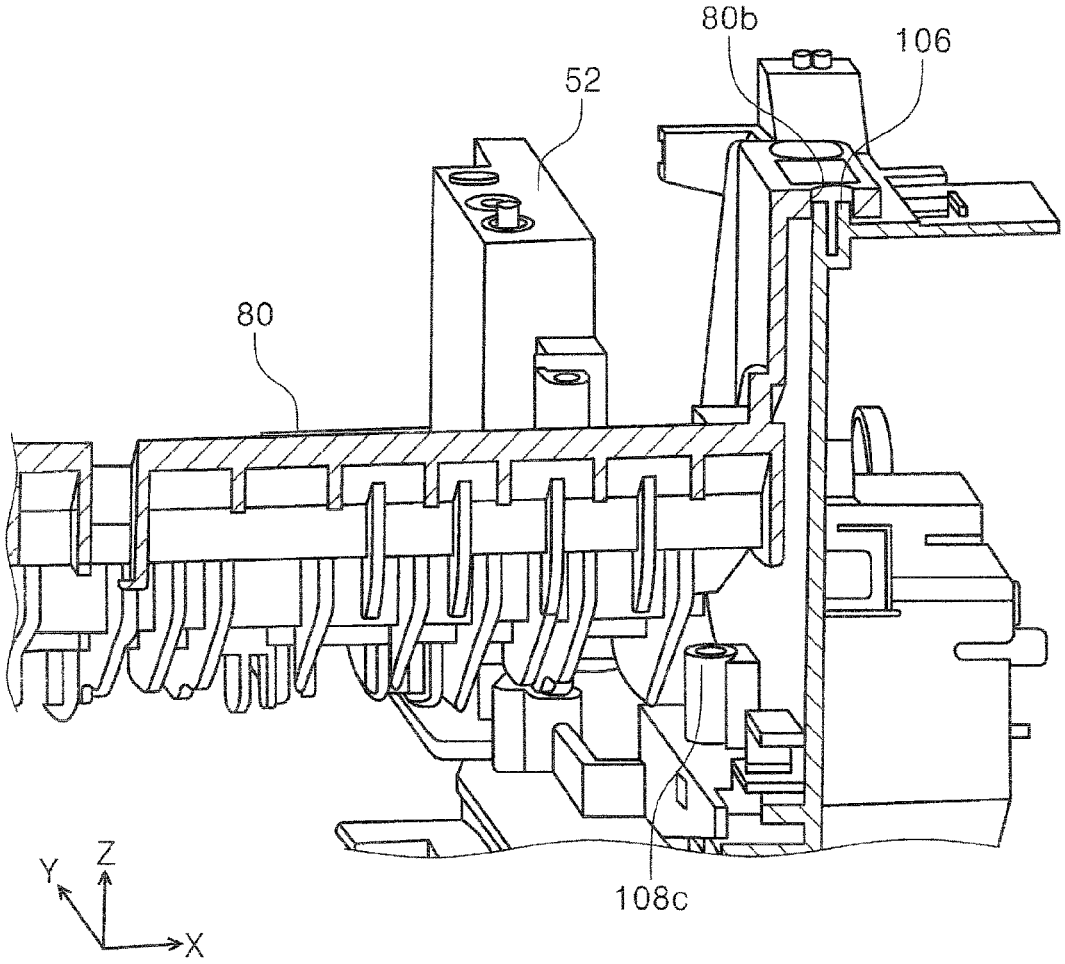
FIG. 22 is a perspective view illustrating a state where one of the mount portions that is not used while the front feed unit is mounted to the first sub-frame does not interfere with the front feed unit.
Figure 23:
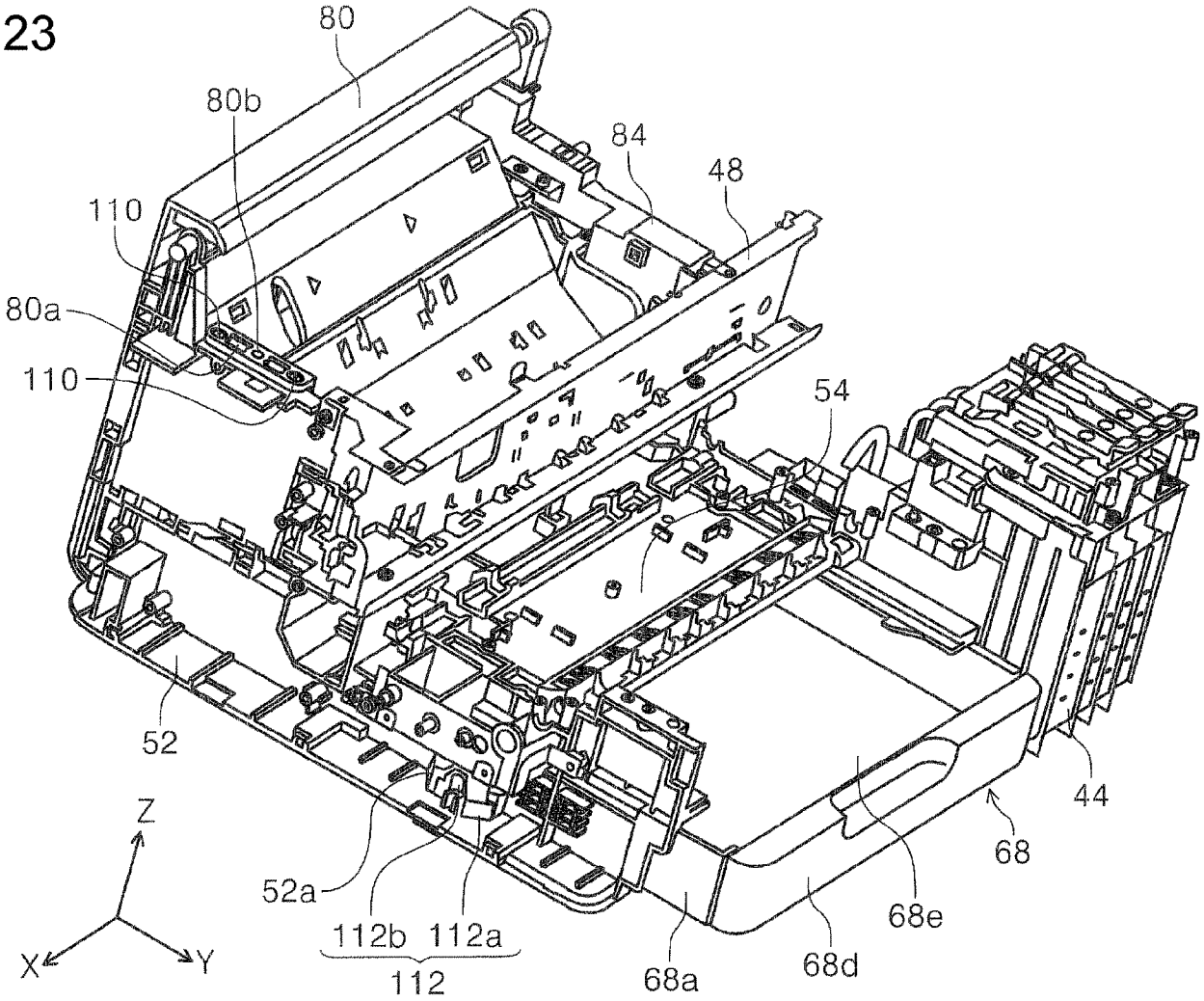
FIG. 23 is a perspective view of the apparatus body of the front feed-type printer as seen from the first sub-frame side.
Figure 24:
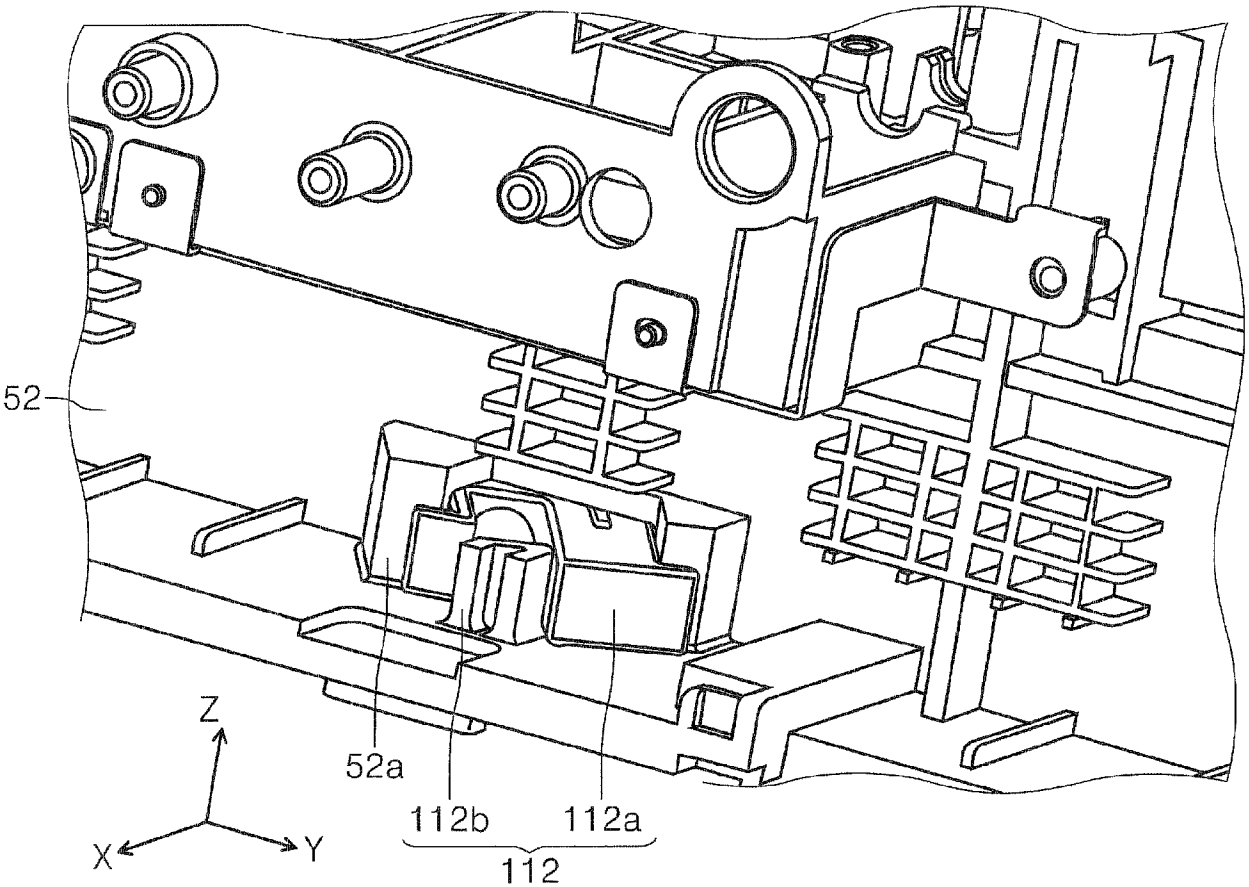
FIG. 24 is a perspective view illustrating a lock cassette provided on the first sub-frame in the front feed type.
Figure 25:
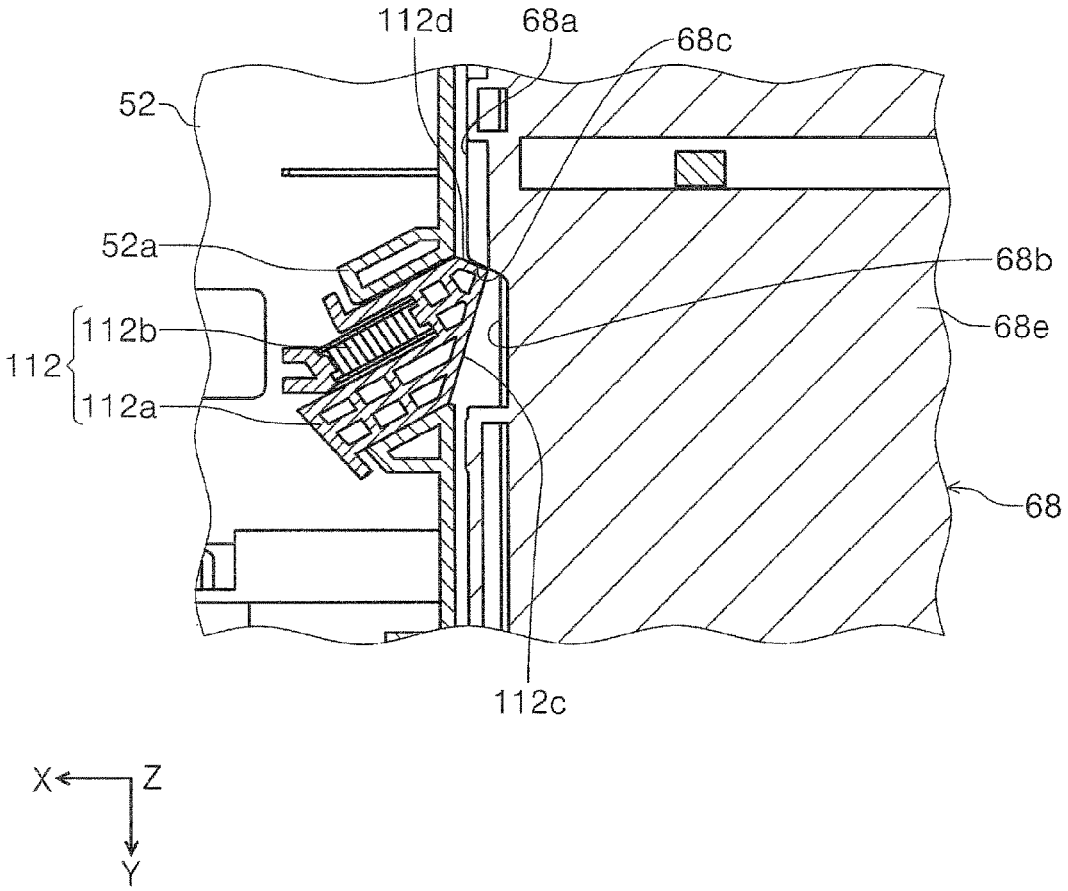
FIG. 25 is a cross-sectional view illustrating the relation between the lock cassette and a medium housing cassette.
Figure 26:
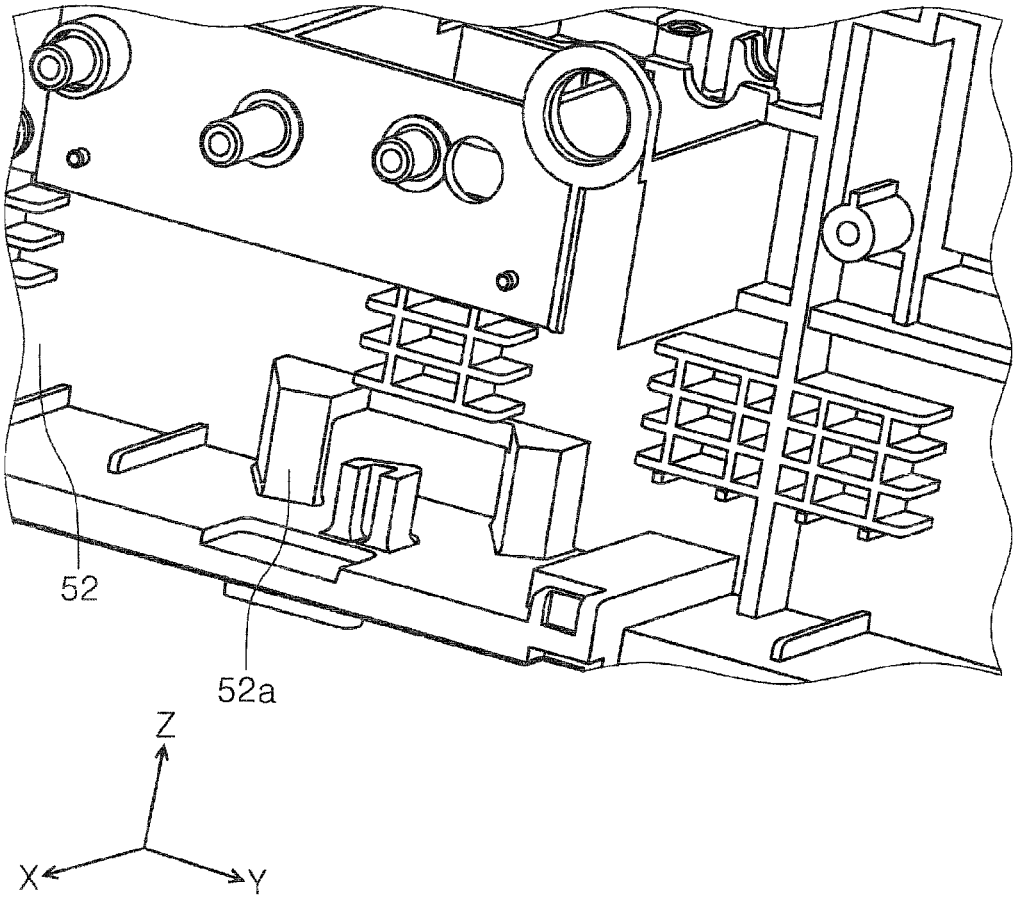
FIG. 26 is a perspective view illustrating a lock-cassette mount portion of the first sub-frame in the rear feed type.
Figure 27:
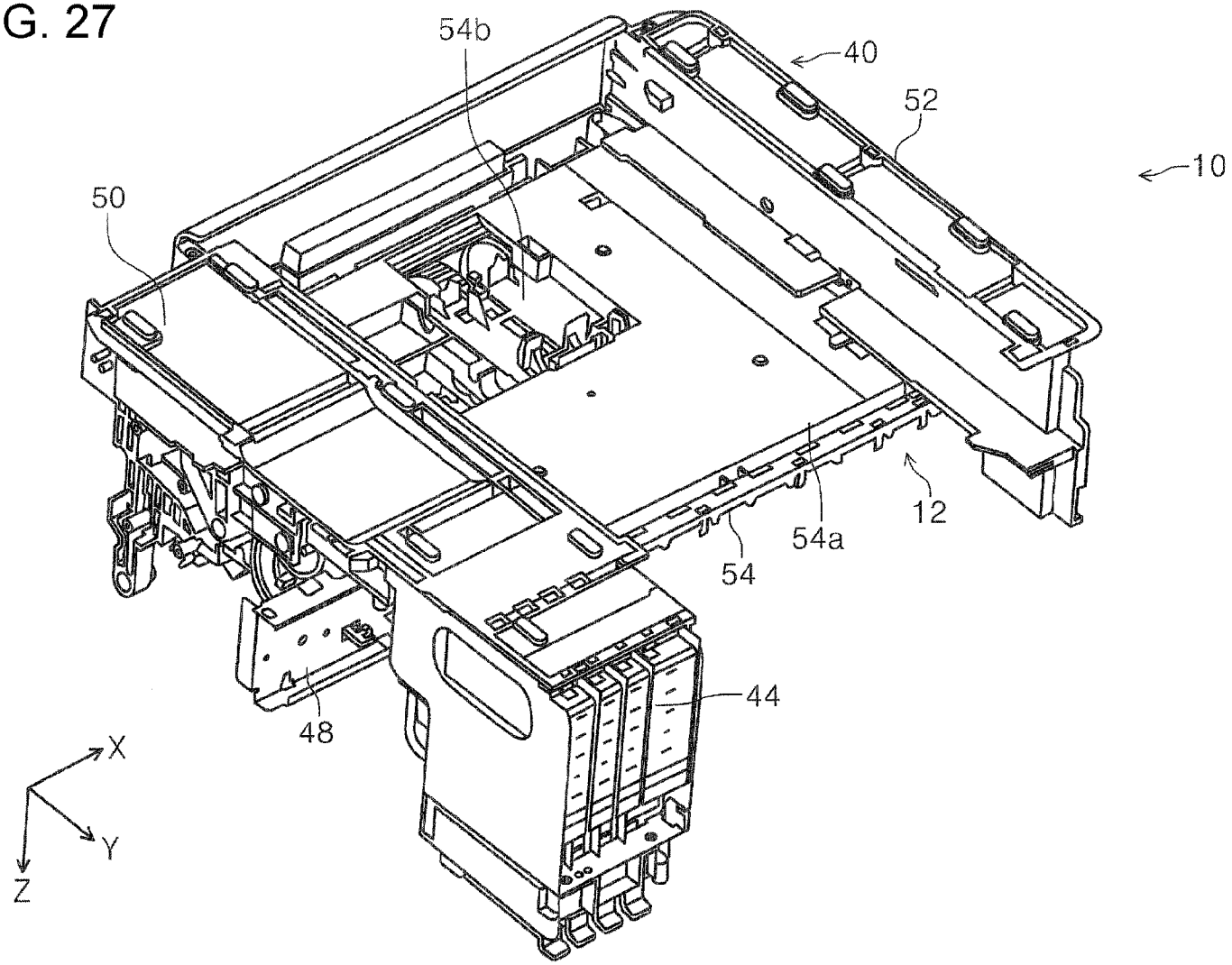
FIG. 27 is a perspective view of the rear feed-type printer as seen from below.
Figure 28:
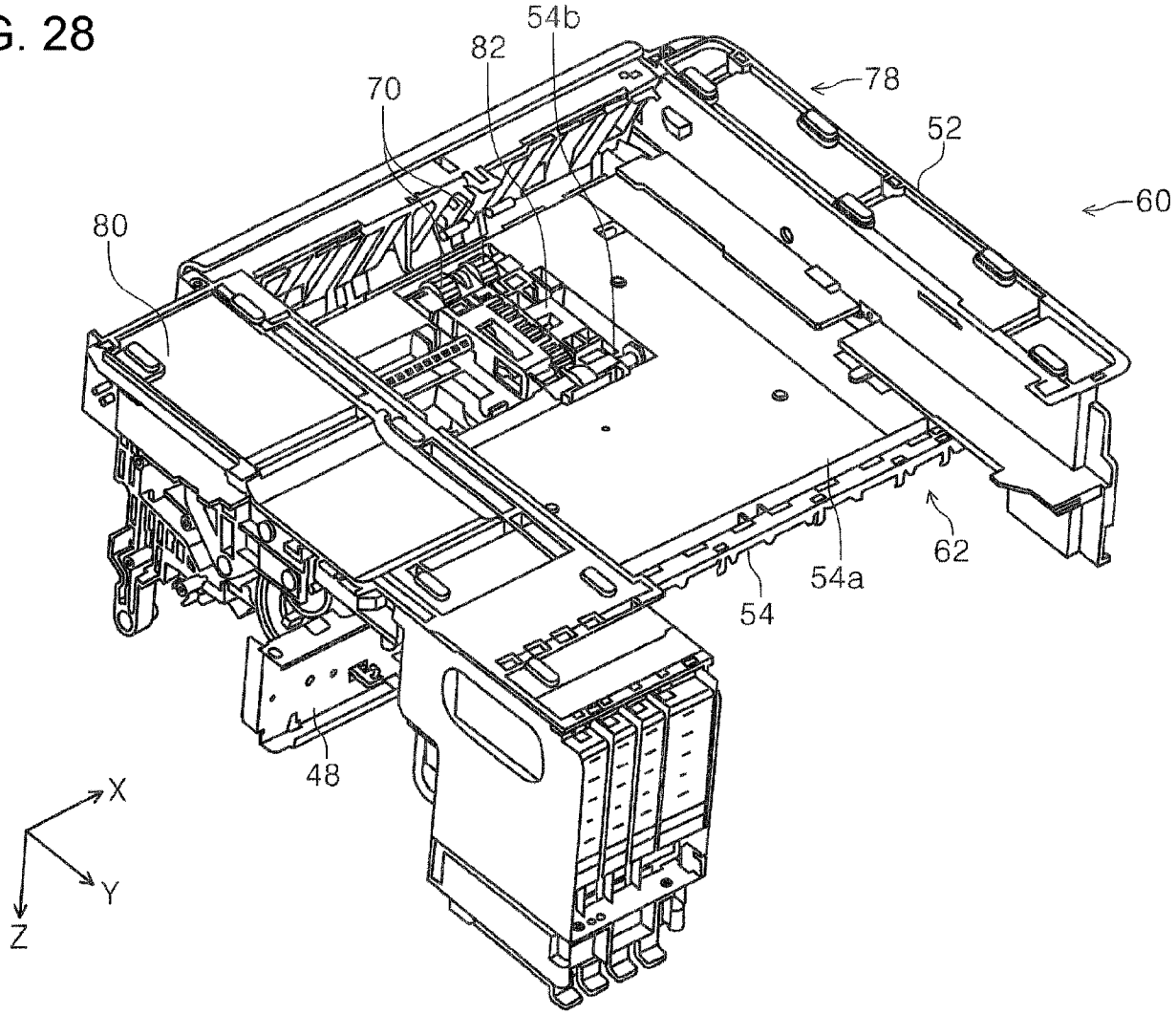
FIG. 28 is a perspective view of the front feed-type printer as seen from below with the medium housing cassette detached therefrom.

FIG. 22 is a perspective view illustrating a state where one of the mount portions that is not used while the front feed unit is mounted to the first sub-frame does not interfere with the front feed unit. FIG. 23 is a perspective view of the apparatus body of the front feed-type printer as seen from the first sub-frame side. FIG. 24 is a perspective view illustrating a lock cassette provided on the first sub-frame in the front feed type. FIG. 25 is a cross-sectional view illustrating the relation between the lock cassette and a medium housing cassette. FIG. 26 is a perspective view illustrating a lock-cassette mount portion of the first sub-frame in the rear feed type. FIG. 27 is a perspective view of the rear feed-type printer as seen from below. FIG. 28 is a perspective view of the front feed-type printer as seen from below with the medium housing cassette detached therefrom.

Figure 29:
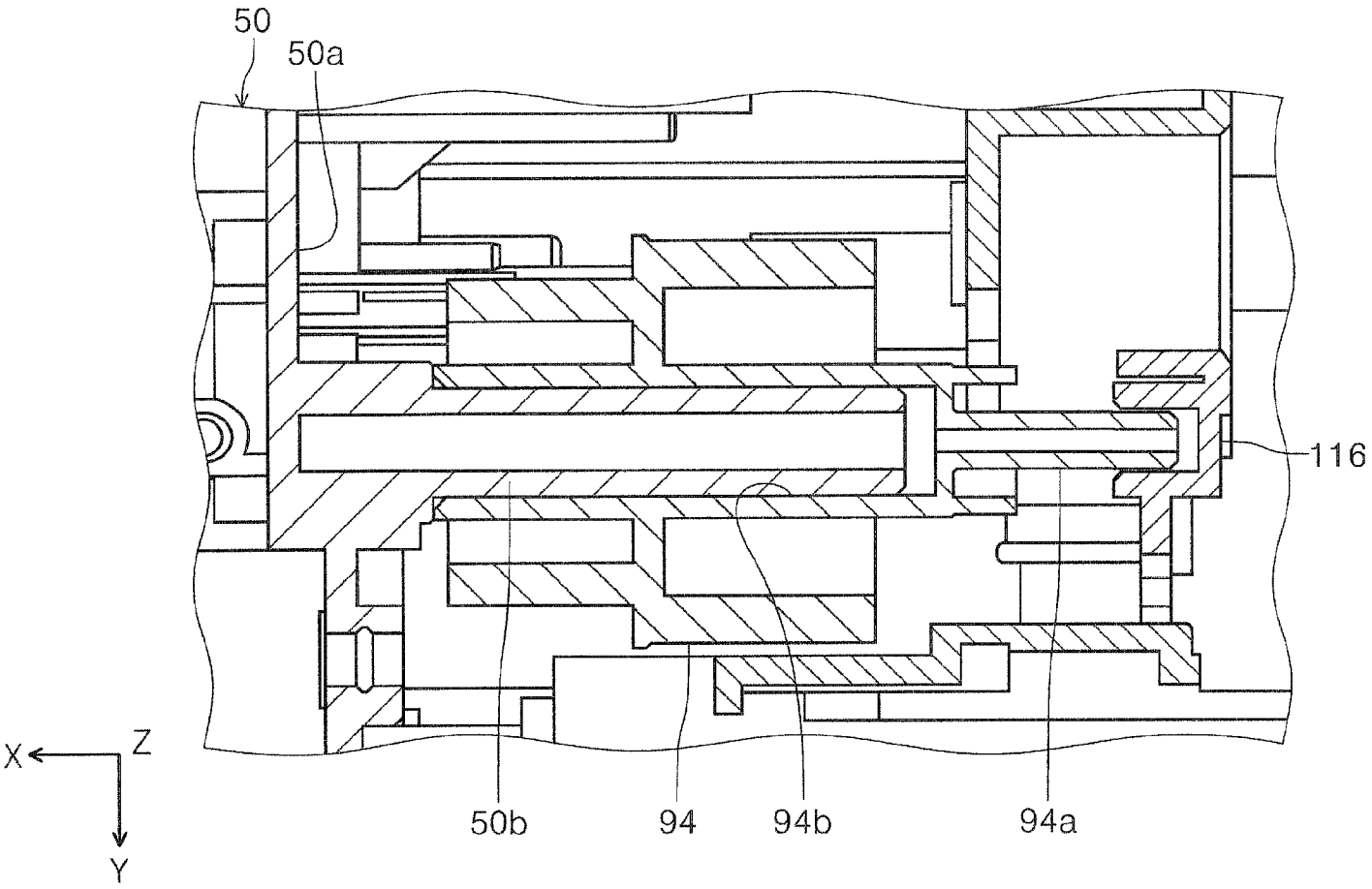
FIG. 29 is a cross-sectional view illustrating how a compound gear is mounted in the first power transmission unit.
Figure 30:
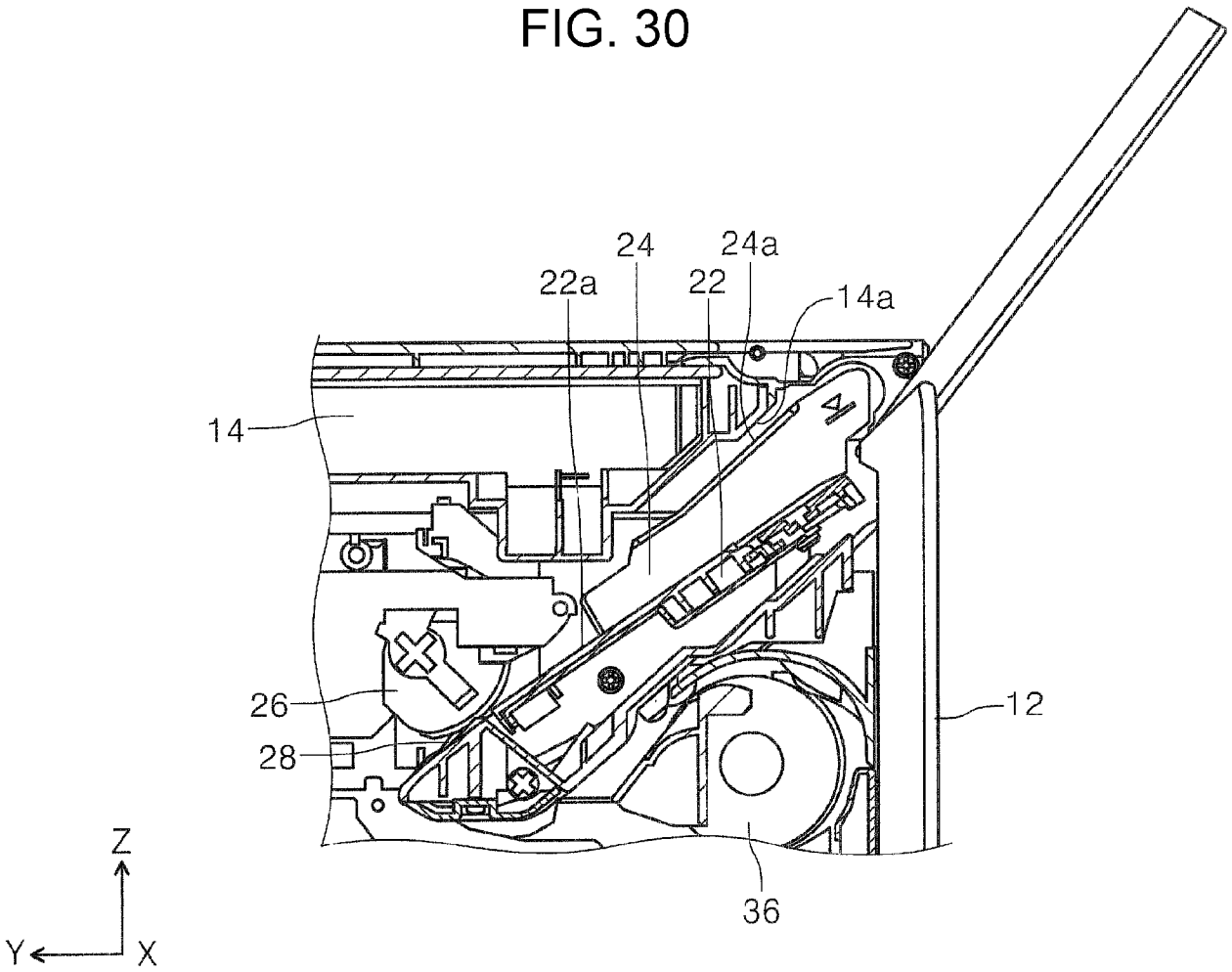
FIG. 30 is a side cross-sectional view illustrating the relation between a scanner and each edge guide of a medium support in the rear feed-type printer.
Figure 31:
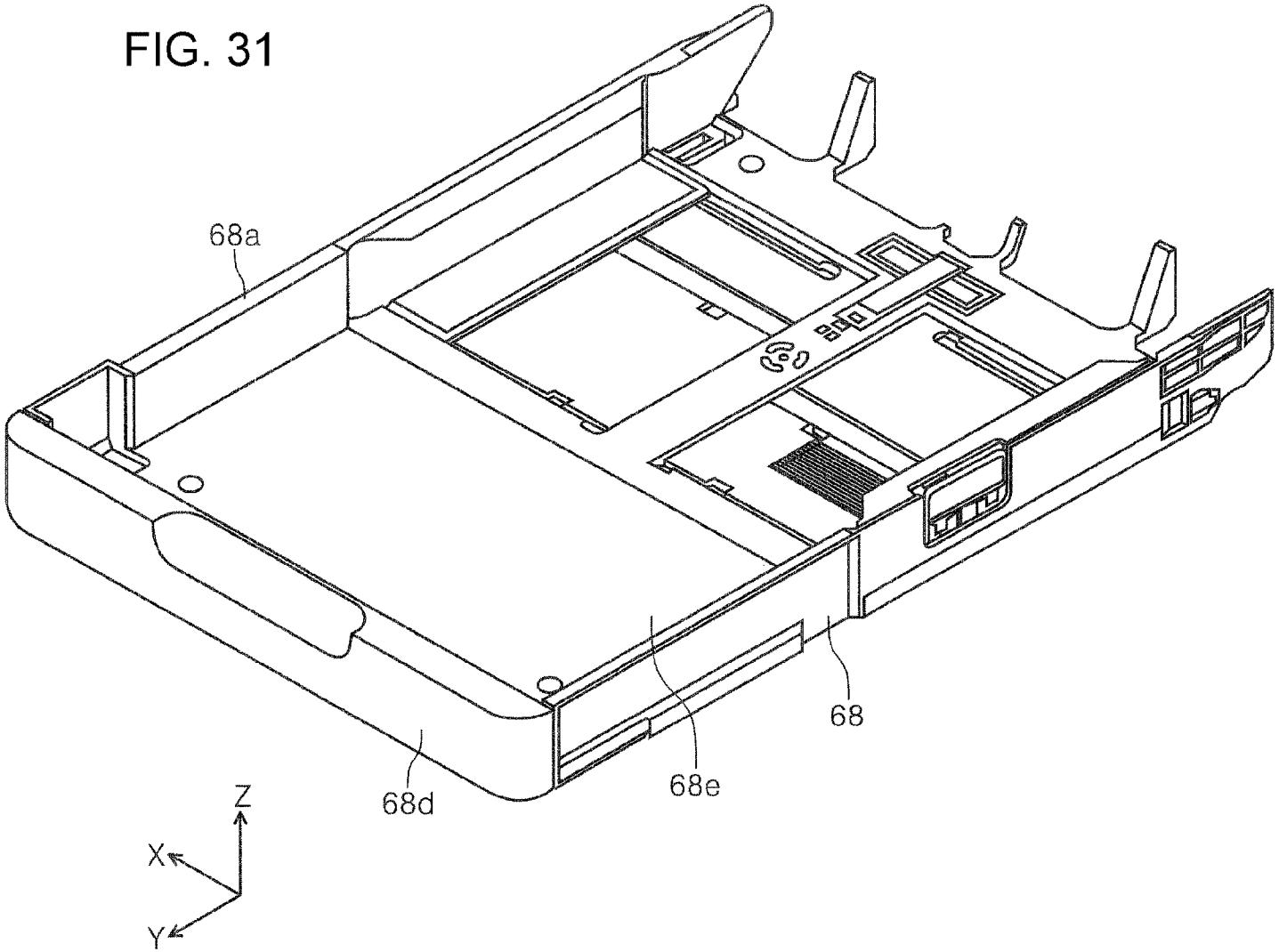
FIG. 31 is a perspective view illustrating a state where a cover of the medium housing cassette in the front feed type is closed.
Figure 32:
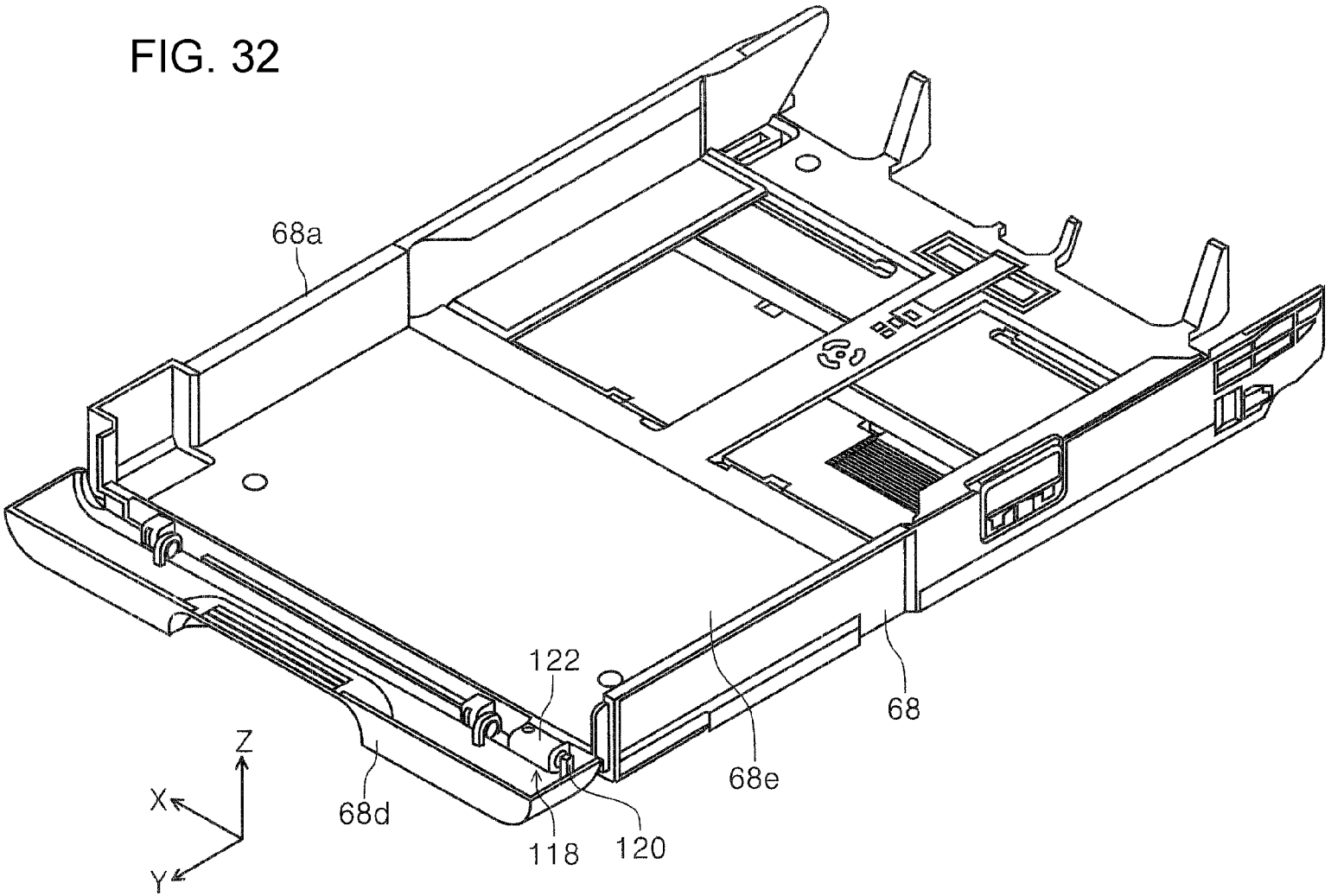
FIG. 32 is a perspective view illustrating a state where the cover of the medium housing cassette in the front feed type is opened.
Figure 33:
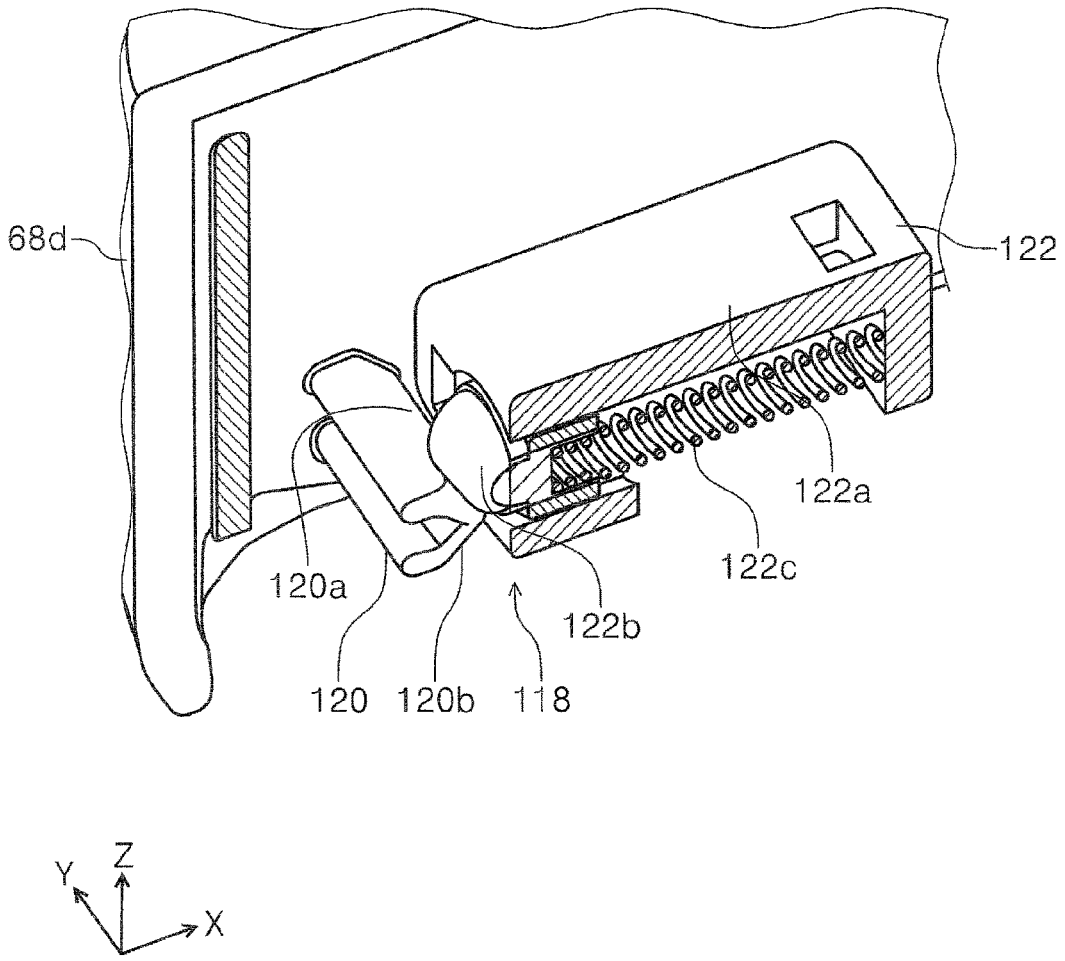
FIG. 33 is a perspective view illustrating a lock unit in the state where the cover of the medium housing cassette is closed.
Figure 34:
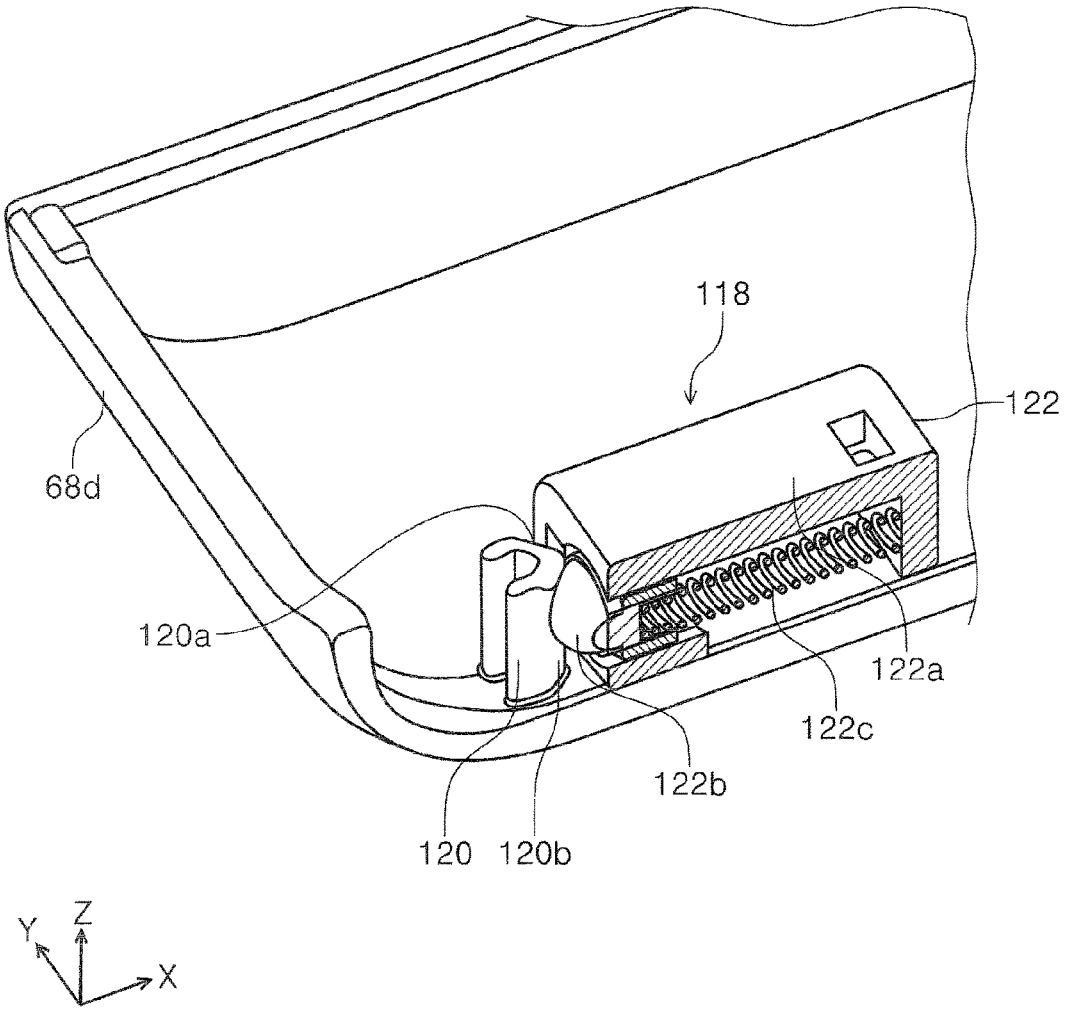
FIG. 34 is a perspective view illustrating the lock unit in the state where the cover of the medium housing cassette is opened.
Figure 35:
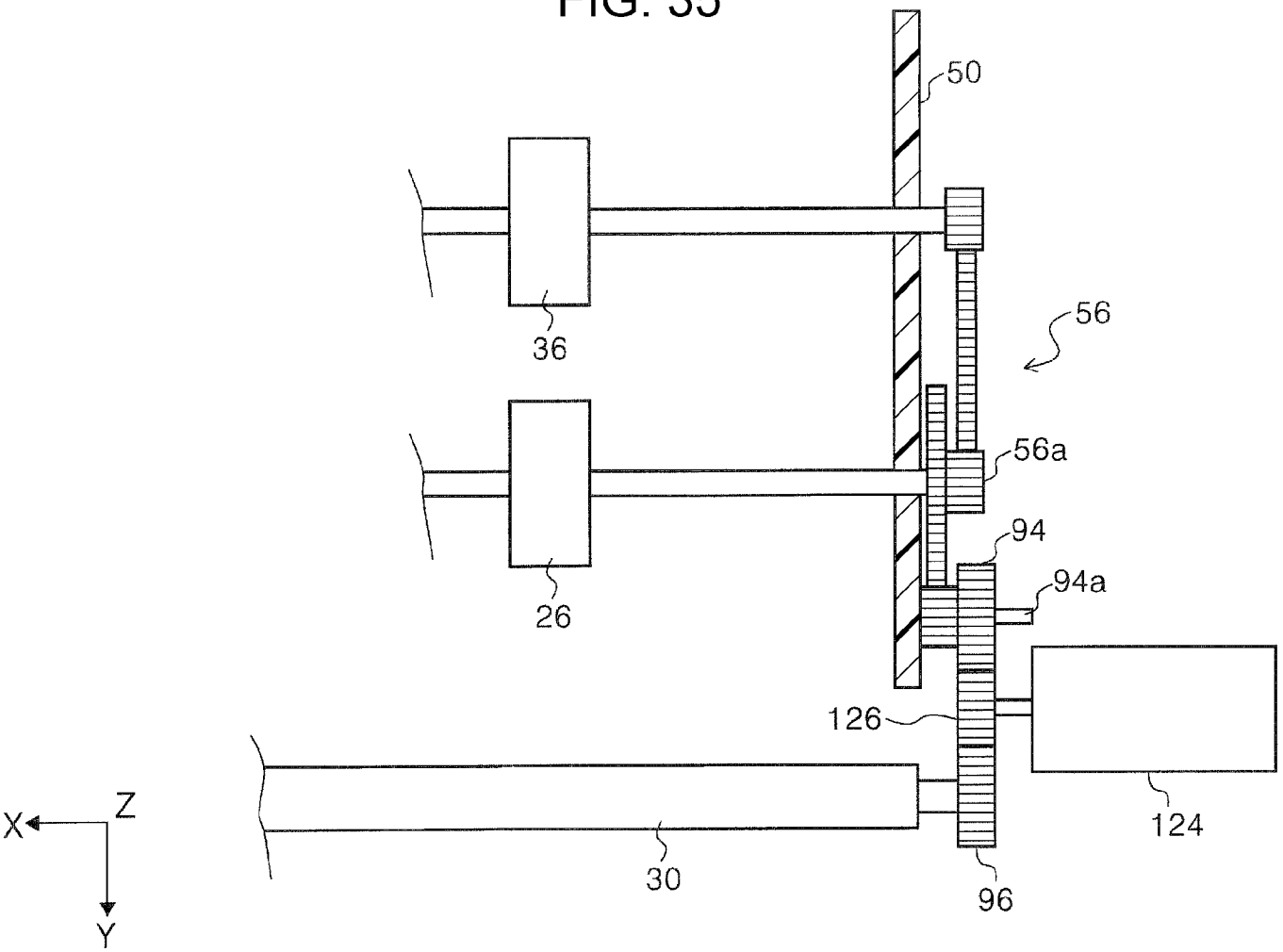
FIG. 35 is a schematic view illustrating a modification in which a drive motor is provided on the second sub-frame side.

FIG. 29 is a cross-sectional view illustrating how a compound gear is mounted in the first power transmission unit. FIG. 30 is a side cross-sectional view illustrating the relation between a scanner and each edge guide of a medium support in the rear feed-type printer. FIG. 31 is a perspective view illustrating a state where a cover of the medium housing cassette in the front feed type is closed. FIG. 32 is a perspective view illustrating a state where the cover of the medium housing cassette in the front feed type is opened. FIG. 33 is a perspective view illustrating a lock unit in the state where the cover of the medium housing cassette is closed. FIG. 34 is a perspective view illustrating the lock unit in the state where the cover of the medium housing cassette is opened. FIG. 35 is a schematic view illustrating a modification in which a drive motor is provided on the second sub-frame side.

Meanwhile, in the X-Y-Z coordinate system illustrated in each of the figures, the X direction represents the direction along the width of a record medium, i.e. the direction along the width of the apparatus, the Y direction represents the direction of transport of a record medium on a transport path inside the recording apparatus, i.e. the direction along the depth of the apparatus, and the Z direction represents the direction along the height of the apparatus.

Overview of the Invention

The basic concept of the invention is that elements such as a liquid container and a waste-liquid container are gathered on one of the frames of a frame assembly constituting the body of a recording apparatus so that the specifications of the recording apparatus can be selected between rear feed-type specifications and front feed-type specifications by changing the one frame, and the other frames can be shared by the rear feed-type specifications and the front feed-type specifications.

EMBODIMENTS

First, a rear feed-type printer 10 as a first model will be described with reference to FIGS. 1 to 6, and a front feed-type printer 60 as a second model will be described with reference to FIGS. 7 to 12.

Rear Feed Type

FIG. 1 illustrates the rear feed-type printer 10 as the first model being an ink jet printer as an exemplary recording apparatus. The printer 10 includes an apparatus body 12 and a scanner unit 14 provided on top of the apparatus body 12. On the front side (+Y direction side) of the apparatus, the apparatus body 12 is provided with an operation unit 16 and a discharge port 18 under the operation unit 16. On the rear side (−Y direction side) of the apparatus body 12, a medium-feed-port cover 20 is mounted to be pivotable relative to the apparatus body 12 and is capable of switching between an opened state (not illustrated) and a closed state (FIG. 1). With the medium-feed-port cover 20 pivoted in the −Y direction into the opened state, media can be fed into the apparatus body 12.

A medium transport path in the printer 10 will be described with reference to FIG. 2. On the −Y direction side of the apparatus body 12, a medium support 22 is provided which supports media in a tilting posture. In one example, the medium support 22 is configured as a hopper. In this embodiment, the medium support 22 is swingable toward a feed roller 26 to be described below. The medium support 22 swings in such a direction as to get closer to the feed roller 26 when a medium is fed, and is situated at a position (see FIG. 2) at which it is separated from the feed roller 26 in a state where no medium is fed, i.e. a standby state. The medium support 22 includes edge guides 24 that guide the sides of a medium set on a support face 22*a* of the medium support 22. The edge guides 24 are movable toward and away from each other in the X-axis direction.

The feed roller 26 and a separation roller 28 are provided downstream of the medium support 22 along the medium transport path. A transport roller 30 as a "medium transporter" is provided downstream of the feed roller 26 and the separation roller 28 in the medium transport direction.

A carriage 32 and a record head 34 as a "recorder" are provided downstream of the transport roller 30. The carriage 32 is movable back and forth in a −X-axis direction as a "first direction" and a +X-axis direction" as a "second direction" inside the apparatus body 12. The record head 34 is provided under the carriage 32. A plurality of nozzles are provided at the lower face of the record head 34 and are capable of ejecting ink as "liquid." A discharge roller 36 is provided downstream of the record head 34 in the medium transport direction.

A medium set on the medium support 22 is fed downstream by the feed roller 26 and the separation roller 28 and introduced by the transport roller 30 to an area where the medium faces the record head 34. Then, the medium is subjected to recording by the record head 34, and the medium after the recording is discharged to the +Y direction side from the discharge port 18 (FIG. 1) by the discharge roller 36. Here, the long dashed short dashed line in FIG. 2, denoted by reference sign P, indicates the path of a medium P fed downstream in the feed direction inside the apparatus body 12 from the medium support 22.

Meanwhile, in a case of performing double-sided recording on a medium, its first face is subjected to recording by the record head 34 and then the transport roller 30 is rotated in the opposite direction to transport the medium to a turnover roller 38 disposed under the medium support 22. The turnover roller 38 turns over the medium and transports the medium toward the record head 34 again. The medium thus turned over is subjected to recording on its second face by the record head 34 and then discharged to the +Y direction side from the discharge port 18 (FIG. 1) by the discharge roller 36.

In FIG. 3, to a frame assembly 40 of the apparatus body 12 are mounted a rear feeder 42 as a "first feeder," ink tanks 44 as a "liquid container," and a waste liquid tank 46 as a "waste-liquid container." The rear feeder 42 includes the medium support 22, the feed roller 26, and the separation roller 28.

In FIG. 4, the frame assembly 40 includes: a main frame 48 as a "center frame" extending in the X-axis direction; a first frame 52 as a "side frame" and a "first sub-frame" connected to the end of the main frame 48 on the +X-axis direction side; a dedicated rear feed frame 50 as a "side frame" and a "second sub-frame" connected to the end of the main frame 48 on the -X-axis direction side; and a lower frame 54 connecting the dedicated rear feed frame 50 and the first frame 52 under the main frame 48. Meanwhile, in this embodiment, the dedicated rear feed frame 50, the first frame 52, and the lower frame 54 are molded from a resin material, for example.

In FIGS. 2 and 3, the rear feeder 42 is mounted to the dedicated rear feed frame 50 and the first frame 52 and is positioned on the −Y direction side relative to the main frame 48 and above the lower frame 54. In this embodiment, the ink tanks 44 are disposed on an end portion of the dedicated rear feed frame 50 on the +Y direction side. The ink tanks 44 store inks of, for example, black, magenta, yellow, and cyan or of other colors as "liquid. Each ink tank 44 and the record head 34 on the carriage 32 are connected by a flexible ink tube (not illustrated) and are capable of feeding the ink stored in the ink tank 44 to the record head 34.

In this embodiment, the waste liquid tank 46 is disposed on an end portion of the dedicated rear feed frame 50 on the −Y direction side. The waste liquid tank 46 is configured to contain waste inks as "waste liquid" being inks sucked by a pump (not illustrated) from inside the nozzles of the record head 34 capped by cappers not illustrated or ejected from the record head 34 toward caps as a result of flushing actions while the carriage 32 is positioned at the end (home position) in the −X direction within the range of movement of the carriage 32. As for the type of installation of the waste liquid tank 46, there are a fixing type by which the waste liquid tank 46 is fixed to the dedicated rear feed frame 50, and a replaceable type by which the waste liquid tank 46 is detachably mounted to the dedicated rear feed frame 50. FIG. 3 exemplarily illustrates the fixing method, in which the waste liquid tank 46 is fixed to the dedicated rear feed frame 50.

In FIGS. 5 and 6, the dedicated rear feed frame 50 includes a first support portion 50*a* as a "support portion" on its upper rear side. A first power transmission unit 56 as a "power transmission unit" and a first switcher 58 (FIG. 6) are provided on the first support portion 50*a*. The first power transmission unit 56 includes gearing 56*a* including a plurality of gears. In one example, a drive motor (not illustrated) is provided on the first frame 52 side, and the power of the drive motor (not illustrated) is transmitted to the first power transmission unit 56 through the transport roller 30. The first power transmission unit 56 is configured to transmit the power to the feed roller 26 through the plurality of gears of the gearing 56*a*. Note that the first switcher 58 (FIG. 6) will be described later.

Front Feed Type

FIG. 7 illustrates the front feed-type printer 60 as the second model. The printer 60 includes an apparatus body 62 and a scanner unit 64. The scanner unit 64 includes a scanner body 64*a* and an automatic document feeder (ADF) 64*b*. An operation unit 16 and a discharge port 18 are provided on the front side of the apparatus body 62, and a medium receiving tray 66 is provided under the discharge port 18. Under the medium receiving tray 66, a medium housing cassette 68 is provided which is capable of being inserted into and pulled out of the apparatus body 62 from the front side of the apparatus body 62.

A medium transport path in the printer 60 will be described with reference to FIG. 8. A pick-up roller 70 is disposed on the -Y direction side of the apparatus body 62 above the medium housing cassette 68. The pick-up roller 70 is pivotable about a pivot shaft 72. The pick-up roller 70 comes into contact with a medium housed in the medium housing cassette 68 to transport the uppermost medium among the media housed in the medium housing cassette 68 along a medium transport path downstream in the transport direction.

A feed roller 74 is provided downstream of the pick-up roller 70 in the medium transport direction. Driven rollers 76*a*, 76*b*, 76*c*, and 76*d* are provided around the feed roller 74 to be rotatable by the feed roller 74. A medium P fed by the pick-up roller 70 is fed by the feed roller 74 and the driven rollers 76*a*, 76*b*, and 76*c* to a transport roller 30 downstream thereof in the transport direction. Then, the medium P is subjected to recording by a record head 34 and discharged by a discharge roller 36 onto the medium receiving tray 66 through the discharge port 18.

In FIG. 9, to a frame assembly 78 of the apparatus body 62 are mounted the medium housing cassette 68, a front feeder 80 as a "second feeder," a pick-up-roller unit 82, ink tanks 44, and a waste liquid tank 46. The front feeder 80 (FIG. 8) includes the feed roller 74 and the driven rollers 76*a*, 76*b*, 76*c*, and 76*d*. The pick-up-roller unit 82 (FIG. 8) includes the pick-up roller 70 and the pivot shaft 72.

In FIG. 10, the frame assembly 78 includes: a main frame 48 as the "center frame" extending in the X-axis direction; a first frame 52 as a "side frame" and the "first sub-frame" connected to the end of the main frame 48 on the +X-axis direction side; a dedicated front feed frame 84 as a "side frame" and the "second sub-frame" connected to the end of the main frame 48 on the −X-axis direction side; and a lower frame 54 connecting the dedicated front feed frame 84 and the first frame 52 under the main frame 48. Meanwhile, in the front feed type too, the dedicated front feed frame 84, the first frame 52, and the lower frame 54 are molded from a resin material, as in the rear feed type.

In FIGS. 8 and 9, the front feeder 80 is mounted to the dedicated front feed frame 84 and the first frame 52 and is positioned on the −Y direction side relative to the main frame 48 and above the lower frame 54. In this embodiment, the ink tanks 44 are disposed on an end portion of the dedicated front feed frame 84 on the +Y direction side, as in the dedicated rear feed frame 50. The configuration of the ink tanks 44 is similar to that of the rear feed type and description thereof will therefore be omitted.

In this embodiment, the waste liquid tank 46 is disposed on an end portion of the dedicated front feed frame 84 on the −Y direction side. In this embodiment, the waste liquid tank 46 is configured as the replaceable type, by which the waste liquid tank 46 is detachably mounted. Specifically, the waste liquid tank 46 is replaced by pulling the waste liquid tank 46 out of the dedicated front feed frame 84 and inserting another waste liquid tank 46 thereinto from the rear side of the apparatus body 62.

In FIGS. 11 and 12, the dedicated front feed frame 84 includes a second support portion 84*a* as the "support portion" on its upper rear side. A second power transmission unit 86 as the "power transmission unit" and a second switcher 88 (FIG. 12) are provided on the second support portion 84*a*. The second power transmission unit 86 includes gearing 86*a* including a plurality of gears. In one example, a drive motor (not illustrated) is provided on the first frame 52 side, and the power of the drive motor (not illustrated) is transmitted to the second power transmission unit 86 through the transport roller 30. The second power transmission unit 86 is configured to transmit the power to the pick-up roller 70 and the feed roller 74 through the plurality of gears of the gearing 86*a*. Note that the second switcher 88 (FIG. 12) will be described later.

Here, as illustrated in FIGS. 3 and 9, the ink tanks 44 and the waste liquid tank 46 are gathered on the dedicated rear feed frame 50 in the rear feed-type printer 10 and gathered on the dedicated front feed frame 84 in the front feed-type printer 60. Thus, in both of the printer 10 with the rear feed-type specifications and the printer 60 with the front feed-type specifications, mechanisms associated with ink are gathered on the second sub-frame (dedicated rear feed frame 50 and dedicated front feed frame 84) side. Then, with these mechanisms and their layout changed as appropriate within the second sub-frame, it is possible to switch between two or more types of specifications by only changing the second sub-frames of the frame assemblies 40 and 78.

Main Frame

Next, the configuration of the main frame 48 and the configurations of the first switcher 58 and the second switcher 88 will be described with reference to FIGS. 13 to 19. The main frame 48 is configured as a member extending in the X-axis direction, as illustrated in FIGS. 4 and 10. In one example, the main frame 48 is configured as a sheet metal member obtained by working a metallic material by pressing or the like. A plurality of openings are formed in the main frame 48 as appropriate in accordance with their purposes. In FIG. 13, an opening 48*a* as a "first portion" is provided at an upper region of an end portion of the main frame 48 on the −X-axis direction side. Moreover, a slit 48*b* as a "second portion" is provided below the opening 48*a*. The slit 48*b* is one of the plurality of openings provided in the main frame 48.

In the rear feed type, as illustrated in FIG. 14, the first switcher 58 is disposed on the −Y direction side relative to the opening 48*a*. The first switcher 58 includes a lever 90 and a gear 92 including a one-time clutch mechanism. The lever 90 is swingably mounted to a shaft 94*a* of a compound gear 94 mounted to the first support portion 50*a* of the dedicated rear feed frame 50. At a tip of the lever 90, a first engagement portion 90*a* is provided which protrudes from the tip substantially in the +Y direction. The first engagement portion 90*a* is engageable with the carriage 32. The lever 90 swings in the −Y direction when the first engagement portion 90*a* comes into engagement with the carriage 32 (FIG. 15). In this state, the clutch mechanism of the gear 92 is disengaged and allows no transmission of power through the first power transmission unit 56.

As illustrated in FIGS. 6 and 14, when the first engagement portion 90*a* is not engaged with the carriage 32, the lever 90 is separated from the gear 92, so that the first engagement portion 90*a* projects from the opening 48*a* of the main frame 48. Then, in this state, the clutch mechanism of the gear 92 is engaged, so that the first switcher 58 puts the first power transmission unit 56 in a power transmitting state. The opening 48*a* functions as a permitting portion that permits the swing (movement) of the lever 90. Note that in FIG. 13, an output gear 96 is mounted to an end portion of the transport roller 30 on the −X direction side. The output gear 96 meshes with the compound gear 94 and transmits power to the first power transmission unit 56.

In FIGS. 16 to 18, the second switcher 88 for the front feed type includes a slider member 98, a cam holder 100, and a biasing unit 102. In one example, the biasing unit 102 is configured as a coil spring. A cam mechanism not illustrated is provided inside the cam holder 100. A hook portion 100*a* is formed on the cam holder 100. The hook portion 100*a* is locked on the opening 48*a* to fix the cam holder 100 of the second switcher 88 to the main frame 48. The opening 48*a* therefore functions as a fixing portion for fixing the cam holder 100 of the second switcher 88 to the main frame 48.

The opening 48*a* hence functions for the rear feed-type specifications as the permitting portion for the action of the first switcher 58 to switch the state of power transmission, and functions for the front feed-type specifications as the fixing portion for fixing the second switcher 88 to the main frame 48. The opening 48*a* is therefore configured as a shared portion whose configuration is shared by two or more types of specifications.

Further, in FIG. 16, a second engagement portion 98*a* formed on the slider member 98 projects from the slit 48*b* in the +Y direction. The second engagement portion 98*a* is movable in the X-axis direction along the slit 48*b*. The slit 48*b* functions as a permitting portion that permits the movement of the slider member 98. The slider member 98 includes a connection portion 98*b* connected to one end of the biasing unit 102. The opposite end of the biasing unit 102 axially biases a gear 104.

FIG. 17 illustrates the second power transmission unit 86 in a non-power transmitting state. In this state, the gear 104 is not in mesh with a gear of the gearing 86*a* of the second power transmission unit 86. As the carriage 32 is moved in the X-axis direction, it comes into engagement with the second engagement portion 98*a*. As the second engagement portion 98*a* is moved in the X-axis direction along the slit 48*b*, the slider member 98 is moved in the X-axis direction, thereby moving the gear 104 in the X-axis direction. As a result, the gear 104 meshes with a gear of the gearing 86*a* of the second power transmission unit 86, so that the second power transmission unit 86 switches from the non-power transmitting state (FIG. 17) to a power transmitting state (FIG. 18).

Here, the slit 48*b* is configured to be used as a portion that guides the slider member 98 for the front feed-type specifications, but not used for the rear fee-type specifications. In the configuration for the rear feed-type specifications, the slit 48*b* does not interfere with other elements, and can therefore be used although the slit 48*b* is provided in the main frame 48. Hence, the configuration of the slit 48*b* in the main frame 48 can exist in both the rear feed-type specifications and the front feed-type specifications.

Positioning Portion and Mount Portions

In FIG. 19, a positioning portion 106 in the shape of a boss is provided on an upper region of an end portion of the first frame 52 on the −Y direction side. Also, mount portions 108*a* and 108*b* are provided in front of and behind the positioning portion 106 in the Y-axis direction, respectively. Further, a mount portion 108*c* is provided below the positioning portion 106 and the mount portions 108*a* and 108*b*.

In FIG. 20, a mounted portion 42*a* is provided on an end portion of the rear feeder 42 on the +X direction side. A positioned portion 42*b* in the shape of a through-hole is provided in the mounted portion 42*a*. In mounting the rear feeder 42 to the first frame 52, the positioning portion 106 in the shape of a boss is inserted into the positioned portion 42*b* in the shape of a through-hole to thereby position the rear feeder 42 relative to the first frame 52. Further, the mounted portion 42*a* of the rear feeder 42 is fixed to the mount portions 108*a* and 108*b* with fastening members 110. Though not illustrated, the rear feeder 42 is fixed to the mount portion 108*c* with a fastening member 110, as in the mount portions 108*a* and 108*b*. Note that in one example, the fastening members 110 are configured as screw members.

In FIG. 21, a mounted portion 80*a* is provided on an end portion of the front feeder 80 on the +X direction side. A positioned portion 80*b* in the shape of a through-hole is provided in the mounted portion 80*a*. In mounting the front feeder 80 to the first frame 52, the positioning portion 106 in the shape of a boss is inserted into the positioned portion 80*b* in the shape of a through-hole to thereby position the front feeder 80 relative to the first frame 52. Further, the mounted portion 80*a* of the front feeder 80 is fixed to the mount portions 108*a* and 108*b* with fastening members 110.

As illustrated in FIG. 22, the mount portion 108*c* is configured not to be used when the front feeder 80 is mounted to the first frame 52. The mount portion 108*c* is provided at such a position on the first frame 52 as not to interfere with the front feeder 80 when the front feeder 80 is mounted to the first frame 52. Hence, the mount portion 108*c* can exist on the first frame 52 in both the rear feed-type specifications and the front feed-type specifications.

Lock Cassette and Lock-Cassette Mount Portion

In FIGS. 23, 24, and 26, a lock-cassette mount portion 52*a* is provided at a lower region of an end portion of the first frame 52 on the +Y direction side. In the front feed-type configuration (FIG. 24), a lock cassette 112 is provided in the lock-cassette mount portion 52*a*. The lock cassette 112 includes a lock-cassette body 112*a* and a biasing unit 112*b*. In one example, the biasing unit 112*b* is configured as a coil spring.

In FIG. 25, the biasing unit 112*b* is disposed between the lock-cassette mount portion 52*a* and the lock-cassette body 112*a*. The biasing unit 112*b* biases the lock-cassette body 112*a* obliquely rearward, specifically, in the −X direction and the −Y direction. A guide face 112*c* is provided on the +Y direction side of a tip of the lock-cassette body 112*a*, and a press face 112*d* is provided on the −Y direction side of the tip.

As the medium housing cassette 68 is inserted into the apparatus body 62, a sidewall 68*a* of the medium housing cassette 68 on the +X direction side presses the guide face 112*c*. Consequently, the lock-cassette body 112*a* is pushed toward the lock-cassette mount portion 52*a* against the biasing force of the biasing unit 112*b*. When the medium housing cassette 68 is inserted to the back of the apparatus body 62, a recessed portion 68*b* provided in the sidewall 68*a* of the medium housing cassette 68 reaches the position where the lock cassette 112 is provided.

Thus, the lock-cassette body 112*a* projects into the recessed portion 68*b* with the biasing force of the biasing unit 112*b*. Then, the press face 112*d* of the lock-cassette body 112*a* comes into engagement with a pressed face 68*c* provided on the recessed portion 68*b*, thereby biasing the medium housing cassette 68 toward the back of the apparatus body 62. As a result, the medium housing cassette 68 is positioned relative to the apparatus body 62.

FIG. 26 illustrates the state of the lock-cassette mount portion 52*a* of the first frame 52 in the printer 10 with the rear feed specifications. Since the medium housing cassette 68 is not used for the rear feed specifications, the lock cassette 112 is not provided in the lock-cassette mount portion 52*a*. Although the lock-cassette mount portion 52*a* is provided on the first frame 52 of the printer 10 with the rear feed specifications, the lock-cassette mount portion 52*a* does not interfere with other elements for the rear feed specifications. Hence, the lock-cassette mount portion 52*a* can exist on the first frame 52 in both the rear feed specifications and the front feed specifications, and the first frame 52 can therefore be shared by both types of specifications.

Lower Frame

In FIGS. 27 and 28, a pick-up-roller-unit mount portion 54*b* is provided in a lower face 54*a* of the lower frame 54. The pick-up-roller unit 82 is not provided in the pick-up-roller-unit mount portion 54*b* in FIG. 27 since the rear feed-type printer 10 is not configured to use the pick-up roller 70.

On the other hand, in FIG. 28, the pick-up-roller unit 82 is provided in the pick-up-roller-unit mount portion 54*b* since the front feed-type printer 60 is configured to use the pick-up roller 70. Meanwhile, illustration of the medium housing cassette 68 is omitted in FIG. 28.

Since the rear feed-type printer is not configured to use the medium housing cassette 68, the pick-up-roller-unit mount portion 54*b* does not interfere with other elements for the rear feed specifications although it is provided in the lower face 54*a* of the lower frame 54. As a result, the pick-up-roller-unit mount portion 54*b* can exist in the lower frame 54 in both the rear feed specifications and the front feed specifications, and the lower frame 54 can therefore be shared by both types of specifications.

As described above, in this embodiment, by changing the dedicated rear feed frame 50 or the dedicated front feed frame 84, corresponding to the second sub-frame, to the other on the frame assemblies 40 and 78, constituting the apparatus bodies 12 and 62, it is possible to select the front feed-type specifications or the rear feed-type specifications. Further, by gathering the ink tanks 44 and the waste liquid tank 46, which are elements associated with ink, on the dedicated rear feed frame 50 and the dedicated front feed frame 84, it is possible to handle changes in specification such as whether the ink tanks 44 are present or absent and whether the waste liquid tank 46 is detachably mounted or fixed. Specifically, in this embodiment, for the rear feed type, a type of specification can be selected from four types of specifications including on-carriage specifications, off-carriage specifications, specifications in which the waste liquid tank 46 is detachably mounted, and specifications in which the waste liquid tank 46 is fixed. Further, a type of specification can likewise be selected from four types of specifications for the front feed type as well. Thus, it is possible to implement recording apparatuses of eight types of specifications by only changing the dedicated rear feed frame 50 or the dedicated front feed frame 84 to the other.

Compound Gear

In FIGS. 5, 6, and 29, a shaft 50*b* protruding in the −X direction is formed on the first support portion 50*a* of the dedicated rear feed frame 50 of the rear feed-type printer 10. The compound gear 94 is rotatably mounted on the shaft 50*b*. In FIG. 29, the compound gear 94 includes an insertion hole 94*b* to be coaxial with the shaft 94*a*. The shaft 50*b* is inserted in the insertion hole 94*b*, so that the shaft 50*b* supports the compound gear 94.

The shaft 94*a* of the compound gear 94 is supported on a frame member 116. The compound gear 94 is therefore supported at its opposite ends. This stabilizes the meshing with the output gear 96 and the gear in the first power transmission unit 56 which meshes with the compound gear 94.

In this embodiment, the shaft 50*b*, which is formed on the first support portion 50*a*, can be short by providing the compound gear 94 with the shaft 94*a*. Here, if the shaft 50*b* were long, the moldability of the dedicated rear feed frame 50, molded from a resin material, would be poor. In this embodiment, however, the shaft 50*b* can be short and the dedicated rear feed frame 50 can therefore be prevented from having poor moldability.

Relation between Medium Support and Scanner Unit

In FIGS. 2 and 30, the medium support 22 includes the edge guides 24. On each edge guide 24, an eave-shaped portion 24*a* is formed which limits the number of media to be set on the support face 22*a*. The eave-shaped portion 24*a* (FIG. 3) is formed to face the support face 22*a* with a predetermined gap left between itself and the support face 22*a*. In this embodiment, the gap between the support face 22*a* and the eave-shaped portion 24*a* is set to be large while the gap between the eave-shaped portion 24*a* and a rear end portion 14*a* of the scanner unit 14 is set to be small.

In this way, contact between media set on the support face 22*a* and the eave-shaped portion 24*a* can be reduced, thereby making it possible to reduce the load applied to the media by the eave-shaped portion 24*a*. Further, since the gap between the eave-shaped portion 24*a* and the rear end portion 14*a* of the scanner unit 14 is narrow, it is possible to prevent insertion of a medium between the eave-shaped portion 24*a* and the rear end portion 14*a* of the scanner unit 14 by mistake when the medium is set onto the support face 22*a*.

Lock Unit for Cover of Medium Housing Cassette

A lock unit 118 for a cover 68*d* of the medium housing cassette 68 will be described with reference to FIGS. 31 to 34. The cover 68*d* is pivotally mounted to a cassette body 68*e* of the medium housing cassette 68 at an end portion of the cassette body 68*e* on the +Y direction side. Specifically, the cover 68*d* is capable of switching between a state where the cover 68*d* is closed (FIG. 31) and a state where the cover 68*d* is opened (FIG. 32). The lock unit 118 (FIGS. 32 to 34) is provided between the cover 68*d* and the cassette body 68*e*.

When the cover 68*d* is in the opened state (FIG. 32) or in the closed state (FIG. 31) relative to the cassette body 68*e*, the lock unit 118 locks the cover 68*d* such that it remains in that state.

The lock unit 118 includes a locked portion 120 provided to the cover 68*d* and a lock portion 122 provided to the cassette body 68*e*. The locked portion 120 is formed in the shape of a pin which, when the cover 68*d* is in the closed state (FIG. 33) relative to the cassette body 68*e*, protrudes from the cover 68*d* toward the cassette body 68*e* in the −Y direction and includes a first locked face 120*a* on its upper side and a second locked face 120*b* on its lower side.

The lock portion 122 includes a lock-portion body 122*a*, a lock pin 122*b*, and a biasing unit 122*c*. The biasing unit 122*c* is disposed between the lock-portion body 122*a* and the lock pin 122*b*. The lock pin 122*b* is configured to project from the lock-portion body 122*a* in the X-axis direction with the biasing force of the biasing unit 122*c*. Note that in one example, the biasing unit 122*c* is configured as a coil spring.

In FIG. 33, when the cover 68*d* is in the closed state, the lock pin 122*b* projects from the lock-portion body 122*a* with the biasing force of the biasing unit 122*c*, so that the tip of the lock pin 122*b* is engaged with the first locked face 120*a* of the locked portion 120. In this state, the lock pin 122*b* presses the first locked face 120*a* with the biasing force of the biasing unit 122*c*, so that the locked portion 120 is locked by the lock portion 122. As a result, the cover 68*d* is locked in the closed state. This can prevent the cover 68*d* from unnecessarily switching from the closed state to the opened state and letting media fall even if the medium housing cassette 68 is tilted.

As the cover 68*d* is pivoted in the +Y direction by a force greater than the biasing force of the biasing unit 122*c*, the first locked face 120*a* pushes away the lock pin 122*b* against the biasing force of the biasing unit 122*c*, so that the first locked face 120*a* is disengaged from the lock pin 122*b* and moved in the +Y direction. As a result, the cover 68*d* in the closed state (FIG. 33) is unlocked.

Thereafter, as the cover 68*d* switches from the closed state (FIG. 31) to the opened state (FIG. 32) relative to the cassette body 68*e*, the lock pin 122*b* projects from the lock-portion body 122*a* again with the biasing force of the biasing unit 122*c* and comes into engagement with the second locked face 120*b*. In this state, the lock pin 122*b* presses the second locked face 120*b* with the biasing force of the biasing unit 122*c*, so that the locked portion 120 is locked by the lock portion 122. As a result, the cover 68*d* is locked in the opened state. Meanwhile, media can be supplied into the medium housing cassette 68 from the front side of the apparatus with the cover 68*d* opened in a state where the medium housing cassette 68 is placed in the apparatus body 62.

Note that, to switch the cover 68*d* from the opened state (FIG. 32) to the closed state (FIG. 31), the cover 68*d* is pivoted in the −Y direction with a force greater than the biasing force of the biasing unit 122*c*, so that the second locked face 120*b* is disengaged from the lock pin 122*b* and the cover 68*d* is unlocked. As a result, the cover 68*d* is switched from the opened state (FIG. 32) to the closed state (FIG. 31).

Modifications of Embodiment (1) This embodiment employs the configuration in which: a drive motor is provided on the first frame 52 side; the transport roller 30 is rotated by the power of the drive motor; and the output gear 96, provided on the end portion of the transport roller 30 on the −X direction side, is caused to mesh with a gear of the gearing 56*a* of the first power transmission unit 56 or a gear of the gearing 86*a* of the second power transmission unit 86 to transmit the power to the first power transmission unit 56 or the second power transmission unit 86. Instead of this configuration, in FIG. 35, a drive motor 124 may be provided on the second sub-frame (dedicated rear feed frame 50 or dedicated front feed frame 84) side. In this configuration, a drive gear 126 is mounted to the drive shaft of the drive motor 124. The drive gear 126 is in mesh with the output gear 96 on the transport roller 30 and also in mesh with a gear of the gearing 56*a* of the first power transmission unit 56 (the compound gear 94 in the illustrated example).

When the drive motor 124 is driven, the drive gear 126 is rotated, so that the power is transmitted to the output gear 96, thereby rotationally driving the transport roller 30. On the other hand, when the drive gear 126 is rotated, the power is transmitted also to the gearing 56*a* of the first power transmission unit 56. With this configuration, even if the transport roller 30 is long in the direction along the width of the apparatus, the transport roller 30 is unlikely to receive loads from the first power transmission unit 56. This can prevent or reduce twisting of the transport roller 30. Note that FIG. 35 represents the configuration in which the power of the drive motor 124 is transmitted to the first power transmission unit 56, the power may be transmitted to the second power transmission unit 86.

(2) This embodiment employs the configuration in which the dedicated rear feed frame 50 includes the first support portion 50*a* and the dedicated front feed frame 84 includes the second support portion 84*a*. Instead of this configuration, a configuration may be employed in which a support frame that supports the first power transmission unit 56 and a support frame that supports the second power transmission unit 86 are prepared, and one of these support frames is mounted to a second sub-frame in accordance with the rear feed-type specifications or the front feed-type specifications. With this configuration, the second sub-frame can be a common frame as well.

(3) In this embodiment, both of the rear feed-type printer 10 and the front feed-type printer 60 are of an off-carriage type including the ink tanks 44. However, a configuration may be employed in which they are of an on-carriage type detachably including a plurality of ink cartridges in the carriage 32.

(4) This embodiment employs the configuration in which the dedicated rear feed frame 50 or the dedicated front feed frame 84, corresponding to the second sub-frame, is changed to the other to implement two or more types of specifications. Instead of this configuration, a configuration may be employed in which first frames 52 are dedicated frames for the rear feed type and the front feed type, and one first frame 52 is changed to the other to implement two or more types of specifications.

To sum up the above description, the printers 10 and 60 include: the main frame 48, which supports the recorder 32 and 34, which performs recording on a medium; and at least two side frames 50 (84) and 52, which are positioned with the main frame 48 interposed therebetween. The two side frames 50 (84) and 52 include: the first frame 52, to which both of the rear feeder 42 and the front feeder 80, which correspond to the first feeder and the second feeder and feed a medium, are mountable, the second feeder differing from the rear feeder 42 in the position from which to feed a medium; and the dedicated rear feed frame 50 or the dedicated front feed frame 84, corresponding to the second sub-frame, to which one of the rear feeder 42 and the front feeder 80 is mountable. The dedicated rear feed frame 50 includes the first support portion 50*a,* which supports the first power transmission unit 56, which transmits drive power from a motor to the rear feeder 42, the motor being a drive source necessary to feed a medium. The dedicated front feed frame 84 includes the second support portion 84*a*, which supports the second power transmission unit 86, which transmits drive power from a motor to the front feeder 80, the motor being a drive source necessary to feed a medium.

According to this aspect, the frames of the printers 10 and 60 include the main frame 48 and the at least two side frames 50 (84) and 52, which are positioned with the main frame 48 interposed therebetween, and both of the rear feeder 42 and the front feeder 80 are mountable to one of the two side frames 50 (84) and 52, namely the first frame 52. In this way, a recording apparatus model including the rear feeder 42 and a recording apparatus model including the front feeder 80 can share at least the main frame 48 and the first frame 52. This can suppress increase in apparatus cost.

Further, one of the rear feeder 42 and the front feeder 80 is mountable to the dedicated rear feed frame 50 or the dedicated front feed frame 84, corresponding to the second sub-frame, or the other of the two side frames 50 (84) and 52. In other words, the dedicated rear feed frame 50 and the dedicated front feed frame 84, corresponding to the second sub-frame, are dedicated frames for the first model and the second model, respectively. The dedicated rear feed frame 50, corresponding to the second sub-frame, includes the first support portion 50*a,* which supports the first power transmission unit 56, which transmits drive power to the rear feeder 42, and the dedicated front feed frame 84, corresponding to the second sub-frame, includes the second support portion 84*a,* which supports the second power transmission unit 86, which transmits drive power to the front feeder 80. In other words, the dedicated rear feed frame 50 and the dedicated front feed frame 84, corresponding to the second sub-frame, include the first support portion 50*a* and the second support portion 84*a* as portions that are likely to be most greatly differ in configuration from each other between the case where the rear feeder 42 is employed and the case where the front feeder 80 is employed. This can eliminate the need for a design taking into account the difference between the first model and the second model in the frames other than the dedicated rear feed frame 50 and the dedicated front feed frame 84, corresponding to the second sub-frame, or minimize a design taking into account the difference between the first model and the second model in the frames other than the dedicated rear feed frame 50 and the dedicated front feed frame 84, corresponding to the second sub-frame. Hence, it is possible to more effectively suppress increase in apparatus cost.

The printers 10 and 60 further include: the first switcher 58, which switches the state of power transmission from the motor to the rear feeder 42 in the case where the rear feeder 42 is mounted to the first frame 52 and the dedicated rear feed frame 50, corresponding to the second sub-frame; and the second switcher 88, which switches the state of power transmission from the motor to the front feeder 80 in the case where the front feeder 80 is mounted to the first frame 52 and the dedicated front feed frame 84, corresponding to the second sub-frame. The first switcher 58 includes the first engagement portion 90*a,* which switches the state of power transmission of the first switcher 58 by being engaged with and moved by the carriage 32, which constitutes the recorder and moves back and forth in a predetermined direction. The second switcher 88 includes the second engagement portion 98*a,* which switches the state of power transmission of the second switcher 88 by being engaged with and moved by the carriage 32. The main frame 48 includes the opening 48*a,* corresponding to the first portion, which permits the movement of the first engagement portion 90*a,* and the slit 48*b,* corresponding to the second portion, which permits the movement of the second engagement portion 98*a.*

In the above configuration, the main frame 48 includes the opening 48*a,* corresponding to the first portion, which permits the movement of the first engagement portion 90*a* and the slit 48*b,* corresponding to the second portion, which permits the movement of the second engagement portion 98*a.* Both of the printer 10, configured as the first model, and the printer 60, configured as the second model, can therefore share the main frame 48. This can suppress increase in apparatus cost.

The opening 48*a* and the slit 48*b* are openings provided in the main frame 48. In this configuration, the opening 48*a* and the slit 48*b* are openings provided in the main frame 48 and can therefore simplify the configuration of the main frame 48.

The waste liquid tank 46, which contains waste liquid ejected from the record head 34, constituting the recorder 32 and 34, is provided on the dedicated rear feed frame 50 or the dedicated front feed frame 84, corresponding to the second sub-frame.

With this configuration, the layout for sucking and containing waste inks ejected from the record head 34 can be integrated on the dedicated rear feed frame 50 and the dedicated front feed frame 84, corresponding to the second sub-frame. In this way, changes in the layout for sucking and containing the waste inks can be limited to the dedicated rear feed frame 50 and the dedicated front feed frame 84, corresponding to the second sub-frame. It is therefore possible to implement two or more types of specifications with the printers 10 and 60 by only changing the dedicated rear feed frame 50 or the dedicated front feed frame 84, corresponding to the second sub-frame, to the other.

The waste liquid tank 46 is detachably mounted to the dedicated rear feed frame 50 or the dedicated front feed frame 84, corresponding to the second sub-frame, or fixed to the dedicated rear feed frame 50 or the dedicated front feed frame 84, corresponding to the second sub-frame.

The ink tanks 44, capable of containing the inks to be ejected from the record head 34, constituting the recorder 32 and 34, are provided on the dedicated rear feed frame 50 or the dedicated front feed frame 84, corresponding to the second sub-frame.

In the above configuration, the ink tanks 44, capable of containing the inks to be ejected from the record head 34, constituting the recorder 32 and 34, are provided on the dedicated rear feed frame 50 or the dedicated front feed frame 84, corresponding to the second sub-frame. Thus, elements associated with inks can be gathered on the dedicated rear feed frame 50 or the dedicated front feed frame 84, corresponding to the second sub-frame. Accordingly, influences of changes in these elements and their layout can be limited to the dedicated rear feed frame 50 or the dedicated front feed frame 84, corresponding to the second sub-frame. It is therefore possible to implement two or more types of specifications by only changing the dedicated rear feed frame 50 or the dedicated front feed frame 84, corresponding to the second sub-frame, to the other on the printers 10 and 60.

The first frame 52 includes the positioning portion 106, which positions the rear feeder 42 relative to the first frame 52 in the case where the rear feeder 42 is mounted to the first frame 52 and the dedicated rear feed frame 50, and positions the front feeder 80 relative to the first frame 52 in the case where the front feeder 80 is mounted to the first frame 52 and the dedicated front feed frame 84.

In the above configuration, the positioning portion 106 serves a function to position the rear feeder 42 and a function to position the front feeder 80. Therefore, the rear feeder 42 and the front feeder 80 can share the positioning portion 106 and do not need to be provided with their respective positioning portions 106. This can suppress increase in cost.

The first frame 52 includes the plurality of mount portions 108*a*, 108*b*, and 108*c*, at which to mount the rear feeder 42 to the first frame 52, and among the plurality of mount portions 108*a*, 108*b*, and 108*c*, the mount portion 108*c* to be used only to fix the rear feeder 42 is provided at such a position as not to interfere with the front feeder 80 when the front feeder 80 is mounted to the first frame 52.

In the above configuration, the first frame 52 includes the plurality of mount portions 108*a*, 108*b*, and 108*c*, at which to mount the rear feeder 42 to the first frame 52, and among the plurality of mount portions 108*a*, 108*b*, and 108*c*, the mount portion 108*c* to be used only to fix the rear feeder 42 is provided at such a position as not to interfere with the front feeder 80 when the front feeder 80 is mounted to the first frame 52. In this way, the rear feeder 42 and the front feeder 80 can share the first frame 52 in an appropriate manner.

The printers 10 and 60 further include the transport roller 30, which transports a medium toward the record head 34, which is the recorder 32 and 34. The drive motor 124, which applies power to the transport roller 30, is provided on the dedicated rear feed frame 50 or the dedicated front feed frame 84, corresponding to the second sub-frame. The drive motor 124 applies power to the rear feeder 42 or the front feeder 80.

In the above configuration, the drive motor 124, which applies power to the transport roller 30, is provided on the dedicated rear feed frame 50 or the dedicated front feed frame 84, corresponding to the second sub-frame, and the drive motor 124 applies power to the rear feeder 42 or the front feeder 80. In this way, the power transmission system is integrated on the rear feed unit 42 or front feeder 80 side. This reduces the power transmission loss and enables more appropriate power transmission.

Also, while the dedicated rear feed frame 50 and the dedicated front feed frame 84, corresponding to the second sub-frame according to the invention, are each used in this embodiment for an ink jet printer as an exemplary recording apparatus, they may be used for other liquid ejecting apparatuses in general.

Here, the liquid ejecting apparatuses are not limited to recording apparatuses such as printers, photocopiers, and facsimiles that use an ink jet-type record head and perform recording on a record-target medium by ejecting ink from the record head. The liquid ejecting apparatuses also include apparatuses that instead eject liquid designed to be used for an equivalent purpose to ink from a liquid ejection head equivalent to the above ink jet-type record head onto an ejection-target medium equivalent to the record-target medium to cause the liquid to adhere to the ejection-target medium.

Such liquid ejection heads besides the above record head include color-material ejection heads for use in manufacturing color filters for liquid crystal displays and the like, electrode-material (conductive-paste) ejection heads for use in forming electrodes for OLED displays, field emission displays (FED), and the like, bioorganic-substance ejection heads for use in making biochips, sample ejection heads as precision pipettes, and so on.

Note that the invention is not limited to the above-described embodiment but various modifications are possible without departing from the scope of the invention described in the claims and embraced within the scope of the invention, as a matter of course.

The entire disclosure of Japanese Patent Application No. 2017-054069, filed Mar. 21, 2017 is expressly incorporated by reference herein.

What is claimed is:

1. A recording apparatus comprising:

a center frame that supports a recorder which performs recording on a medium; and at least two side frames positioned with the center frame interposed therebetween, wherein the two side frames include a first sub-frame to which both of a first feeder and a second feeder that feed a medium are mountable, the second feeder differing from the first feeder in a position from which to feed a medium, and a second sub-frame to which one of the first feeder and the second feeder is mountable, and the second sub-frame includes a support portion that supports a power transmission unit which transmits drive power from a motor to the first feeder or the second feeder, the motor being a drive source necessary to feed a medium.

2. The recording apparatus according to claim 1, further comprising:

a first switcher that switches a state of power transmission from the motor to the first feeder in a case where the first feeder is mounted to the first sub-frame and the second sub-frame; or a second switcher that switches a state of power transmission from the motor to the second feeder in a case where the second feeder is mounted to the first sub-frame and the second sub-frame, wherein the first switcher includes a first engagement portion that switches a state of power transmission of the first switcher by being engaged with and moved by a carriage which constitutes the recorder and moves back and forth in a predetermined direction, the second switcher includes a second engagement portion that switches a state of power transmission of the second switcher by being engaged with and moved by the carriage, and the center frame includes a first portion that permits the movement of the first engagement portion and a second portion that permits the movement of the second engagement portion.

3. The recording apparatus according to claim 2, wherein the first portion and the second portion are openings provided in the center frame.

4. The recording apparatus according to claim 1, wherein a waste-liquid container that contains waste liquid ejected from a record head constituting the recorder is provided on the second sub-frame.

5. The recording apparatus according to claim 4, wherein the waste-liquid container is detachably mounted to the second sub-frame.

6. The recording apparatus according to claim 4, wherein the waste-liquid container is fixed to the second sub-frame.

7. The recording apparatus according to claim 1, wherein a liquid container capable of containing liquid to be ejected from a record head constituting the recorder is provided on the second sub-frame.

8. The recording apparatus according to claim 1, the first sub-frame includes a positioning portion that positions the first feeder relative to the first sub-frame in a case where the first feeder is mounted to the first sub-frame and the second sub-frame, and positions the second feeder relative to the first sub-frame in a case where the second feeder is mounted to the first sub-frame and the second sub-frame.

9. The recording apparatus according to claim 8, wherein the first sub-frame includes a plurality of mount portions at which to mount the first feeder to the first sub-frame, and among the plurality of mount portions, a mount portion to be used only to fix the first feeder is provided at such a position as not to interfere with the second feeder when the second feeder is mounted to the first sub-frame.

10. The recording apparatus according to claim 1, further comprising a medium transporter that transports a medium toward the recorder, wherein a drive source that applies power to the medium transporter is provided on the second sub-frame, and the drive source applies power to the first feeder or the second feeder.

* * * * *